US005578978A

United States Patent [19]

Zoerner

[11] Patent Number: 5,578,978

[45] Date of Patent: Nov. 26, 1996

[54] ELECTRO-FLUID ACTUATOR AND SYSTEM

[75] Inventor: Marty M. Zoerner, Reed City, Mich.

[73] Assignee: Nartron Corp., Reed City, Mich.

[21] Appl. No.: 169,526.

[22] Filed: Dec. 20, 1993

Related U.S. Application Data

[63] Continuation-in-part of Ser. No. 922,069, Jul. 29, 1992, abandoned.

[51] Int. Cl.[6] ..... H01F 7/18

[52] U.S. Cl. ..... 335/239; 335/240

[58] Field of Search ..... 335/28, 29, 59, 335/61, 62, 64, 239–242, 255

[56] References Cited

U.S. PATENT DOCUMENTS

| | | | |
|---|---|---|---|
| 3,326,511 | 6/1967 | Hallgreen | 251/129.15 X |
| 4,139,182 | 2/1979 | Toshironagase | 16/51 X |
| 4,220,266 | 9/1980 | Braden et al. | 16/84 X |
| 4,358,691 | 11/1982 | Naylor | 310/14 X |
| 4,567,910 | 2/1986 | Slavin et al. | 251/129.15 X |
| 4,896,127 | 1/1990 | Hida | 335/239 |
| 5,118,077 | 6/1992 | Miller et al. | 251/129.15 |

*Primary Examiner*—Brian W. Brown
*Assistant Examiner*—Raymond M. Barrera
*Attorney, Agent, or Firm*—Lon H. Romanski

[57] ABSTRACT

A refrigerator with a freezer section and a passage for the flow of ice through the closed freezer section door is provided with a solenoid-like actuator which is effective for quickly opening a related ice dispenser door upon initiation of the flow of ice, and which is effective for relatively slowly closing the related ice dispenser door to thereby assure that further ice will not pass into the passage after the ice dispenser door is closed.

49 Claims, 11 Drawing Sheets

21
21
90
94
102
104
106
107
108
109
110
112
113
116
120
122
123
124
132
134
136
138
140
151
152
154
168
170
172
176
180
182
184
186
188
196
242
244
246
248
260
262
264
266
268
270
272
274
276
278
280

28
28
27
27
412
400
402
178f
172f
406
140f
132f
154f
262f
134f
136f
260f
404
122f
116f
138f
120f
152f
151f
280f
90f
278f
410
272f
276f
274f
242f
112f
170f
244f
104f
246f
113f
168f
408
402
248f
123f
102f
94f
176f
115f
124f
108f
106f
110f
266f
107f
109f

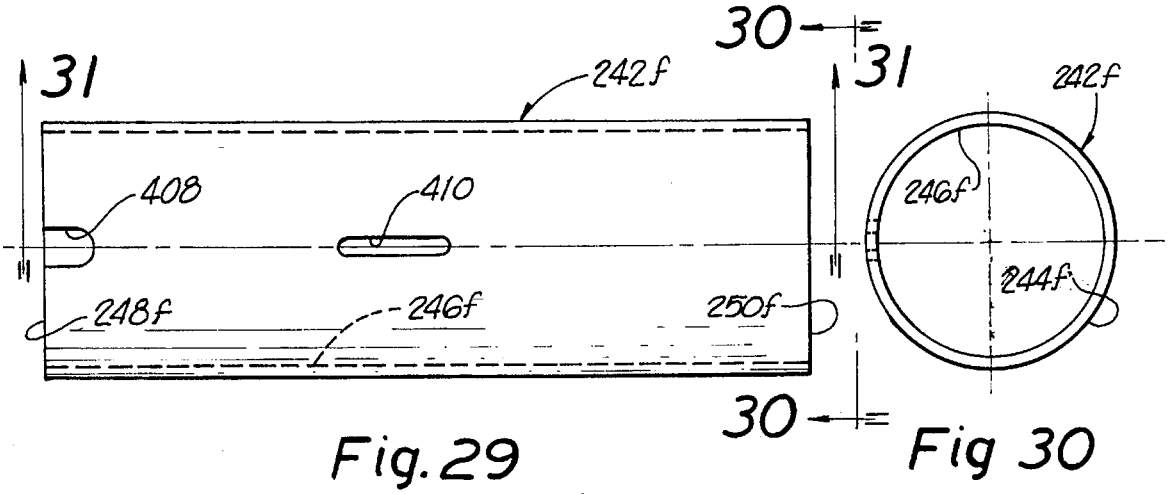
Fig. 29
Fig 30
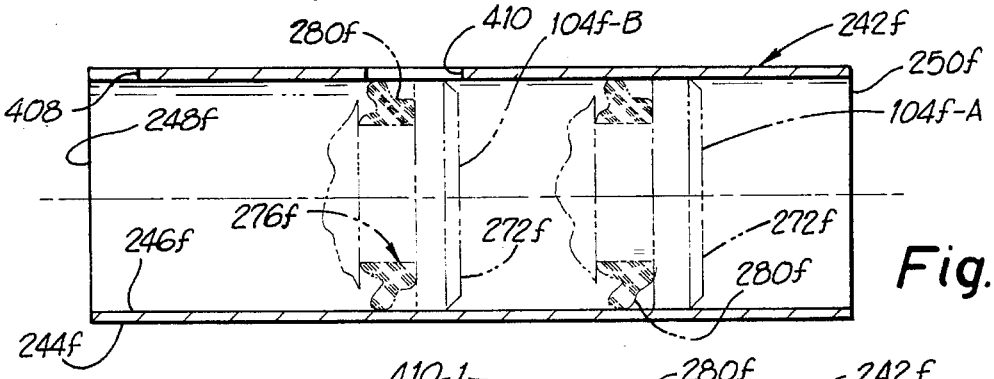
Fig. 31
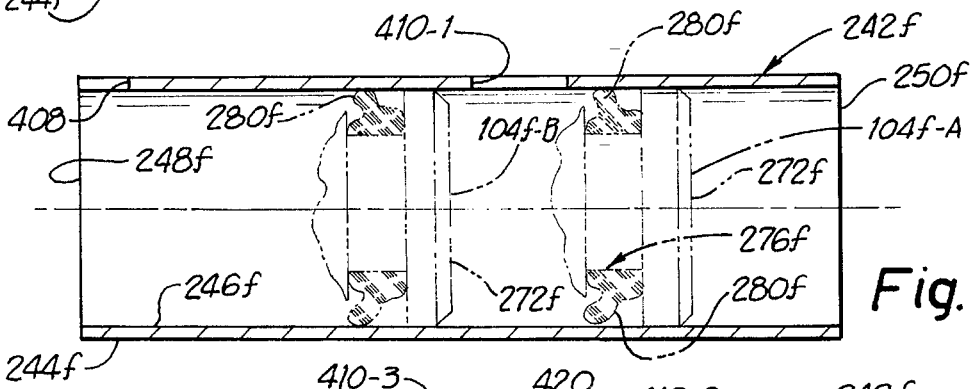
Fig. 32
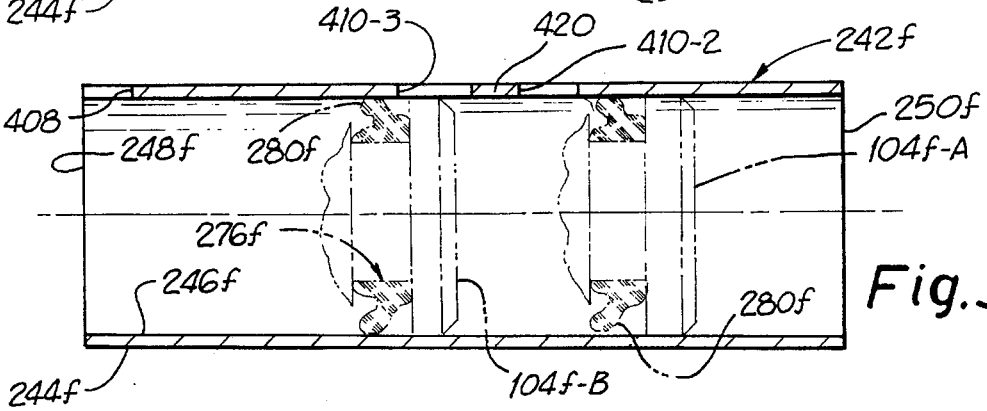
Fig. 33

ELECTRO-FLUID ACTUATOR AND SYSTEM

This application is a Continuation-in-Part of my application Ser. No. 07/922,069 filed Jul. 29, 1992, for "Electro-Fluid Actuator and System", now abandoned.

FIELD OF THE INVENTION

This invention relates generally to solenoid motors and more particularly to solenoid motors wherein the armature is to have, in at least one direction, a linear speed which is substantially different from the linear speed thereof in a direction opposite to said one direction.

BACKGROUND OF THE INVENTION

Home refrigerators equipped with ice making and ice dispensing capability have become popular and, to a significant degree, commonplace. In such refrigerators there is usually an ice dispenser door which, upon being activated to its opened position, allowes ice to be dispensed therepast and into a receiving vessel such as a glass or the like.

Heretofore, it has been common practice, in the prior art, to bring about the actuation of the ice dispenser door by means of a wax pellet actuator. That is, the actuator included a chamber and a relatively movable piston with such piston being operatively connected to the ice dispenser door as through, for example, suitable lever or other linkage means. The wax pellet was contained within the chamber and effectively constrained therein by the piston. A related electrically energized heating coil was placed into operative relationship with the wax pellet and when a person desired ice to be dispensed, the person would place the vessel (for receiving the ice) against an associated switch thereby closing the circuit through and energizing the heating coil.

As the heating coil heated the wax pellet, the wax expanded forcing the piston outwardly and through such motion and related linkage means cause the ice dispensing door (usually spring loaded toward its closed position) to open. This, then, would allow ice to be dispensed past the opened ice dispenser door and into the receiving vessel held by the person.

When the person received the desired amount of ice, into the receiving vessel, the person would move such receiving vessel away from the previously mentioned switch thereby terminating the energization of the heating coil and permitting the melted wax to again solidify thereby allowing the piston to retract into said chamber and the ice dispenser door to close.

In such prior art arrangements, provision was made whereby high electrical power was first provided in order to melt the wax, as to have the ice dispenser door open as quickly as possible, and then a reduced electrical power was provided to maintain the ice dispenser door open, for as long as required, without overheating the wax. Still, even with such provisions, the ice dispenser door of the prior art is relatively slow to open and too slow to close.

The invention as herein disclosed is primarily directed to at least reducing, if not eliminating, the aforestated prior art problems and to other related and attendant problems.

SUMMARY OF THE INVENTION

According to the invention, an electrically energized actuator comprises electrical field coil means, armature means at least partly situated generally within said field coil means, resilient means, and fluid-flow-restriction means, wherein said electrical field coil means is effective upon being electrically energized to move said armature means in a first direction, wherein said armature means in moving in said first direction moves against resilient resistance of said resilient means, wherein said armature means in moving in said first direction produces an actuating output movement, wherein upon said electrical field coil means becoming electrically de-energized said resilient means is effective to move said armature means in a second direction opposite to said first direction, and wherein said fluid-flow restriction means is effective to govern the speed at which said armature means moves in said second direction so that said speed in said second direction is less than the speed at which said armature means moves in said first direction.

Various general and specific objects, advantages and aspects of the invention will become apparent when reference is made to the following detailed description considered in conjunction with the accompanying drawings.

BRIEF DESCRIPTION OF THE DRAWINGS

In the drawings, wherein for purposes of clarity certain details and/or elements are eliminated from one or more views:

FIG. 29 is a generally longitudinal view of one of the elements shown in axial cross-section in FIG. 26;

FIG. 30 is a view taken generally on the plane of line 30—30 of FIG. 29 and looking in the direction of the arrows;

FIG. 31 is an axial cross-sectional view taken generally on the plane of line 31—31 of FIG. 29 and looking in the direction of the arrows;

FIG. 32 is a view similar to that of FIG. 31 but illustrating a modification of the structure of FIG. 31; and FIG. 33 is a view similar to that of both FIGS. 31 and 32 but illustrating a modification of the structures of FIGS. 31 and 32.

DETAILED DESCRIPTION OF THE PREFERRED EMBODIMENTS

Figure 1:
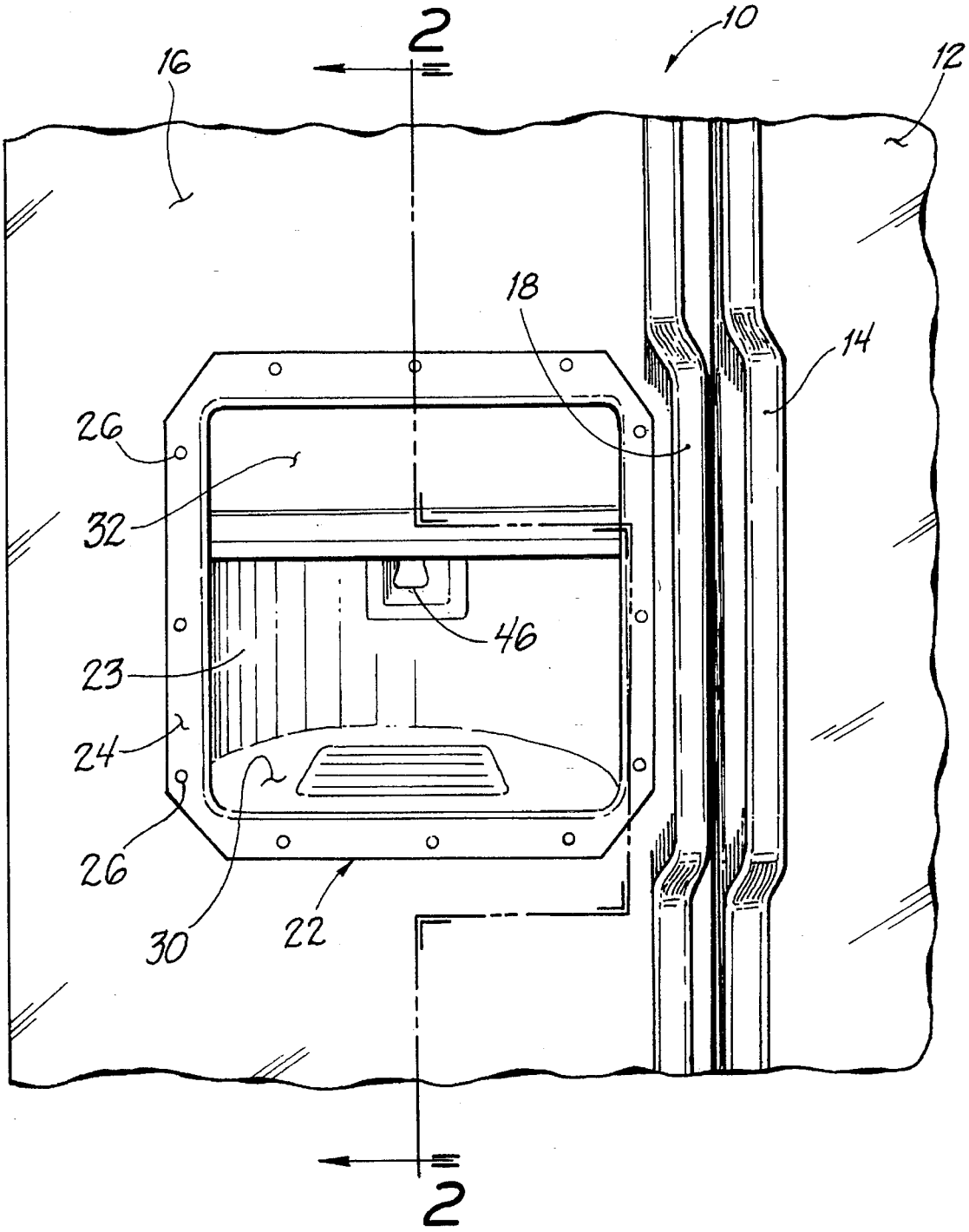
FIG. 1 is a fragmentary view, in elevation, of a refrigerator assembly employing teachings of the invention.

Referring now in greater detail to the drawings, FIG. 1 illustrates, in fragmentary elevational view, a refrigerator assembly 10 which, by way of example, comprises separate inner compartments wherein the one at the right side, access to which is obtained through an openable door 12 provided with handle means 14, is for the relatively short term storage of items of food maintained therein at, for example, 40.0° F.

The compartment at the left side, access to which is obtained through an openable door 16 provided with handle means 18, is for the relatively longer term storage of items of food maintained therein at, for example, 20.0° F., and for the production and storage of ice which may take the form of cubes, sectors or other configurations. Often such compartment is referred to as the "freezer" or "freezer section" while the door 16 is often referred to as the "freezer door".

The refrigerator assembly 10 is of the type which enables a person to obtain ice, as for cooling a beverage, from the freezer compartment 20 without having to open freezer door 16.

Figure 2:
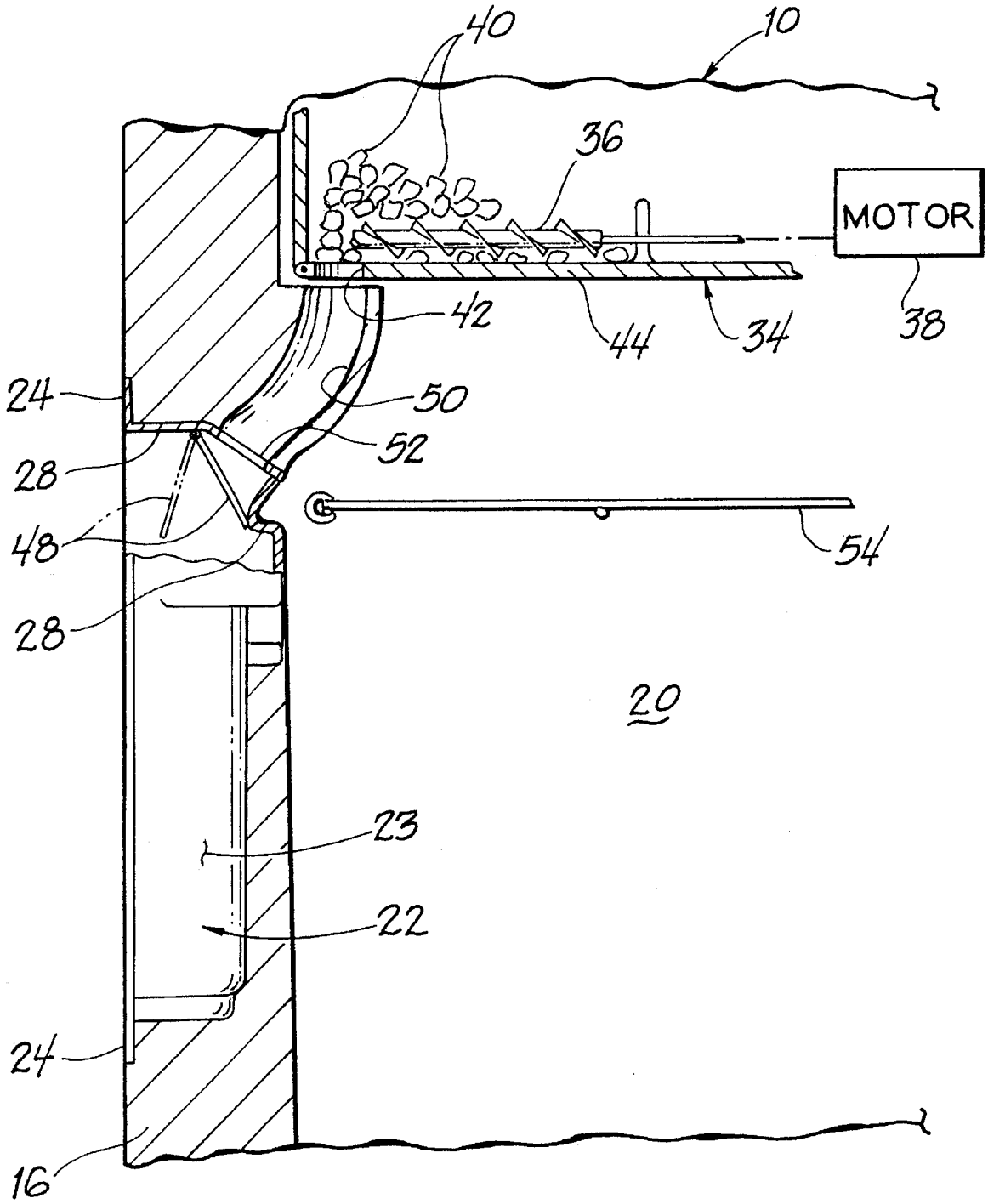
FIG. 2 is a view taken generally on the plane of line 2—2 of FIG. 1 and looking in the direction of the arrows.

Referring to both FIGS. 1 and 2, the freezer door 16, shown closed, is relatively thick and carries, recessed therein, a housing assembly 22 which may comprise a housing portion 23 with a flange 24 by which the housing assembly 22 is secured to door 16 as by any suitable securing means 26. In the embodiment depicted, the housing portion 23 is generally concave with an upper disposed wall portion or means 28 and a lower disposed horizontally extending wall portion or means 30. The housing assembly 22, may be provided with a forwardly and upwardly situated depending wall section 32 which may serve as a splash guard or the like. The flange 24 and other portions of the housing assembly 22 may be, and usually are, provided with decorative covering.

Referring primarily to FIG. 2, as is generally well known, the freezer section 20 is depicted as comprising an ice storage container 34 which may, in turn, carry a screw type conveyor 36 which, when an operatively connected electric motor 38 is energized, rotates and drives the chunks or pieces of ice 40 to the left (as viewed in FIG. 2) as to fall through aperture means 42 formed as through the bottom or floor 44 of ice container 34.

The motor 38 is energized upon an electrical switch 46 (FIG. 1) being closed and, at such time, an ice dispensing door 48 (FIG. 2) is caused to be open. The electrical switch 46 is closed as by a person pressing a drinking glass or receiving vessel thereagainst.

When such energization is brought about, the ice pieces 40 fall through aperture 42 and into and through a generally aligned passage or conduit 50 formed in or carried by freezer door 16. The ice then passes through suitable aperture means 52 of housing assembly 22 and past the opened ice dispenser door 48 into the person's ice receiving vessel (not shown).

When the person removes the ice receiving vessel from switch means 46, motor 38 is de-energized and ice dispenser door 48 is closed. The freezer compartment 20 may contain suitable storage shelves as typically depicted at 54.

Figure 3:
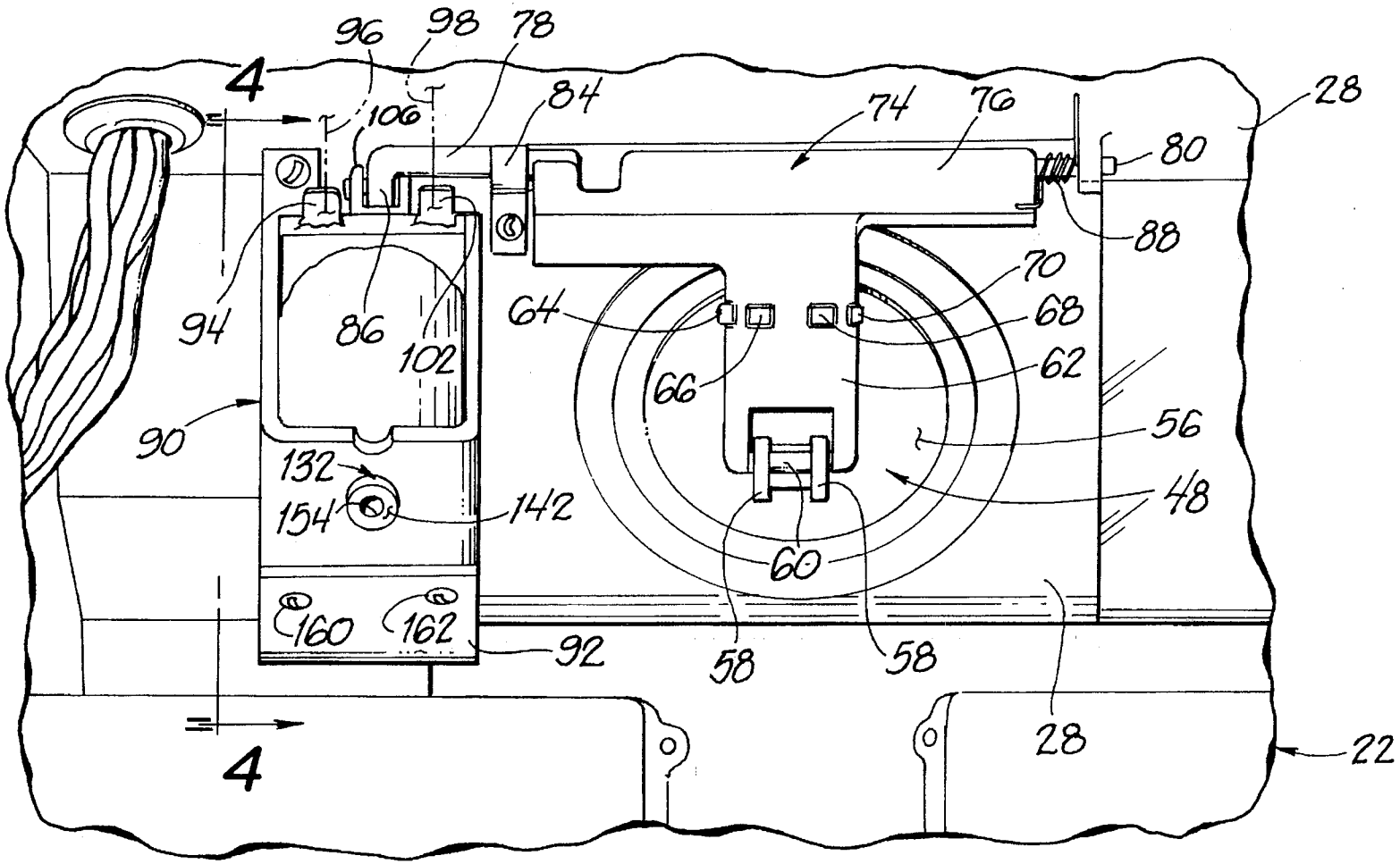
FIG. 3 is an enlarged view of a fragmentary portion of the structure shown in FIG. 1 with certain parts, shown in FIG. 1, being removed for purposes of clarity and illustration.

FIG. 3 is a relatively enlarged fragmentary view of a portion of the housing assembly 22. More particularly, such view is obtained as by removing the wall 32 (FIG. 1) from the assembly 22 and looking generally perpendicularly to the plane of FIG. 1.

The ice dispenser door 48 is depicted as comprising a relatively rigid centrally situated disc-like main body 56 which, in turn, carries a pair of hook-like arms 58—58 that engage a transverse rod-like portion 60 of a lever arm 62, and carries additional retainers 64, 66, 68 and 70 which are operatively connected to arm 62 thereby substantially rigidly connecting dispenser door body 56 to arm 62 for movement in unison therewith. Further, door body 56 carries a circular or disc-like portion 72 which is comprised of rubber or plastic and is relatively flexible as to provide a proper seal when closed as depicted in FIGS. 2 and 3.

The door carrying or actuating lever 74, which comprises arm 62, has a generally transversely extending body 76 provided with oppositely extending shaft-like portions 78 and 80 with shaft portion 80 being journaled as in a supporting lug portion 82 carried by housing 22. The other shaft portion 78 is held in a journal-like condition as by a suitably configured retainer-like member 84. The left-most end of shaft portion 78 is shown formed as to be a lever-like or arm portion 86 which swings as shaft 78 and lever assembly 74 rotate. Further, a torsion spring 88 is provided as about shaft 80 and placed in a manner whereby the torsion spring 88, when permitted, moves lever assembly 74 and ice dispenser door 48 to a closed position.

An electro-fluid actuator assembly 90, supported as by a bracket 92 secured to the housing 22, is operatively connected to arm portion 86 so that upon energization of actuator assembly 90 lever 74 is caused to rotate, against spring 88, and thereby move ice dispenser door 48 to an open position.

Figure 4:
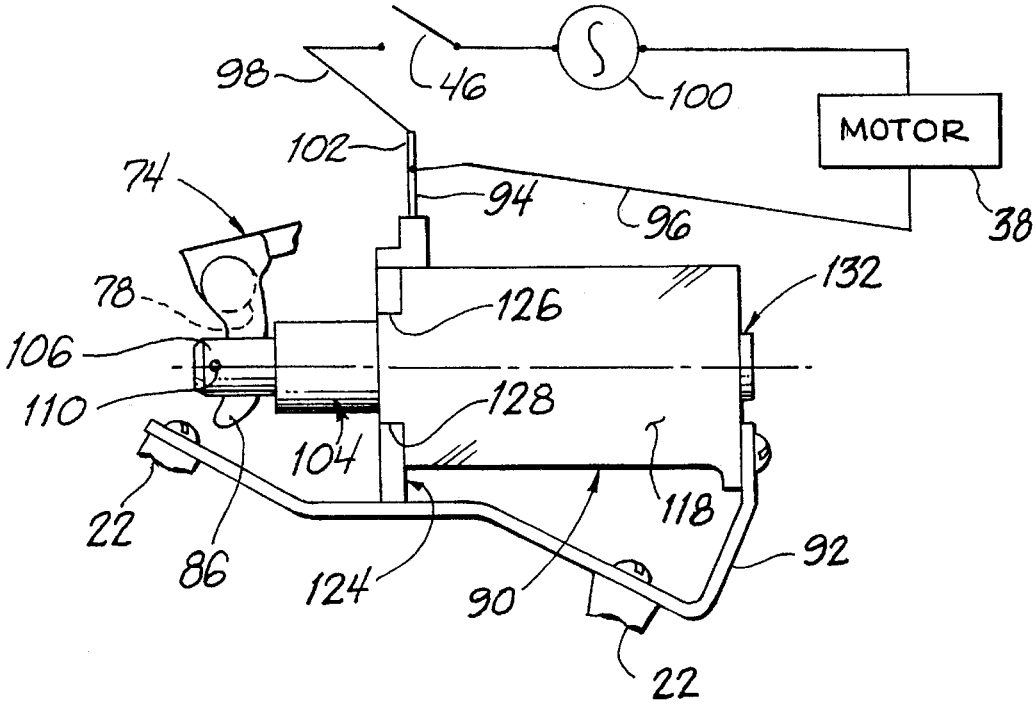
FIG. 4 is a view taken generally on the plane of line 4—4 of FIG. 3 and looking in the direction of the arrows.

FIG. 4 is a partial view taken generally on the plane of line 4—4 of FIG. 3 and looking in the direction of the arrows and rotated as to show the actuator assembly 90 horizontally disposed. As somewhat simplistically and schematically depicted, terminal 94 of actuator 90 is electrically connected as via conductor means 96 to electric motor means 38 (also see FIG. 2). Other conductor means 98 comprising a source of e.m.f. 100 and normally open switch means 46 (also see FIG. 1) electrically interconnects motor 38 and terminal 102 of actuator 90. The left end of the actuator rod or armature means 104 is of a yoke-like configuration, having spaced yoke arms 106 and 108 for receiving therebetween the arm or lever portion 86 of shaft 78. A pin 110 inserted into such yoke arms and traversing the space therebetween serves to engage lever or arm 86, and, when the associated field coil is energized move to the right (as viewed in FIG. 4) thereby cause counter-clockwise (as viewed in FIG. 4) rotation of lever means 74 and ice dispenser door 48 resulting in the passage means 50 becoming completely open.

When switch 46 is again opened, the torsion spring 88 causes the lever means 74 to undergo clockwise (as viewed in FIG. 4) rotation and the closing of passage means 50 by shutting the ice dispenser door 48.

Referring now primarily to FIGS. 5, 6, 7 and 8, the actuator assembly 90 is illustrated as comprising a field coil assembly 112, which may be suitably wrapped as with dielectric material 114, with such coil assembly 112 being generally situated generally within a flux conducting generally U-shaped frame 116. Such flux frame 116 may be considered as comprising generally parallel side walls 118, 120 each integrally joined to or formed with an end wall 122. A flux conducting end plate 124 has oppositely disposed recessed or cut-out portions 126—126 which respectively receive therein tangs 128—128 of frame side walls 118 and 120. An aperture or passage 130 formed through end plate 124 allows for the free movement therethrough of the armature means or actuator rod 104.

FIGS. 3, 4, 5 and 6 depict a stop member 132, extending through the frame wall 122, which, among other things serves as a stop for the armature means or actuator rod 104. As will become apparent and with additional reference to FIGS. 9 and 10, the stop member 132 is inserted through a relatively closely sized aperture 134 as to have shoulder 136 abut against the inside surface 138 of wall 122 and have the generally cylindrical portion 140, of reduced diameter, extend through aperture 134 with end face 142 extending outwardly. In the preferred embodiment, the stop member 132 is then retained in such passage 134 of wall 122 by peened portions 144 and 146.

Figure 10:
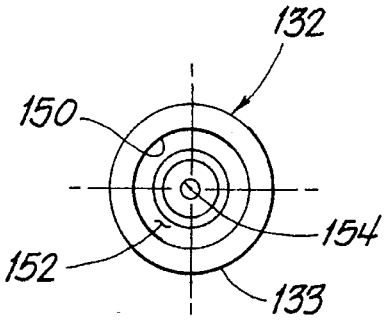
FIG. 10 is a view taken generally on the plane of line 10—10 of FIG. 9 and looking in the direction of the arrows.
Figure 9:
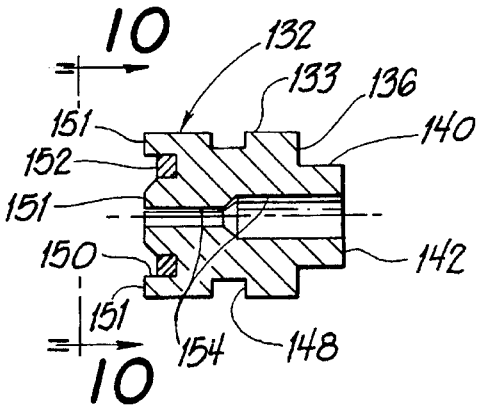
FIG. 9 is an axial cross-sectional view, in relatively enlarged scale, of one of the elements shown in FIG. 6 taken generally on the plane of line 9—9 of FIG. 6 and looking in the direction of the arrows.
Figure 11:
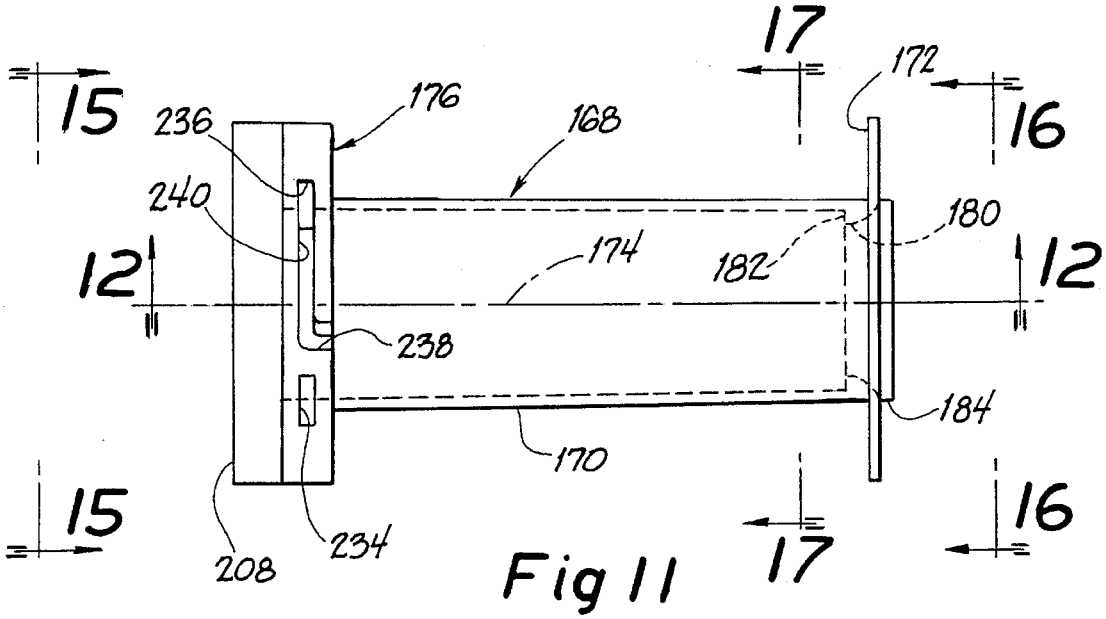
FIG. 11 is a top plan view, in relatively enlarged scale, of another of the elements of the structure of FIGS. 5 and 6.

As best seen in FIGS. 9 and 10, the stop member 132 is of generally stepped cylindrical configuration and comprises an annular groove 148 for the reception therein of suitable sealing means, and an inner axial end which is preferably provided with a generally circular groove 150 which, in turn, receives and retains a copper shading ring 152. In the preferred embodiment, the stop 132 sans ring 152, is comprised of steel. An axially extending passage or conduit 154, which may be formed of stepped diameter, is formed through and axially of stop member 132.

Referring again to FIGS. 6 and 5, in the preferred embodiment a pair of tapped or threaded holes 156 and 158 are formed into end wall 122 for cooperative action as with retaining screws 160 and 162 (FIG. 3), respectively. Also, as generally depicted in FIG. 6, respective electrical leads 164 and 166, from opposite ends of the field coil, are suitably electrically connected to respective electrical terminals 94 and 102 which, in the preferred embodiment, are carried by a portion of the bobbin means 168 comprising a portion of the overall field coil assembly 112.

Referring now primarily to FIGS. 11–17, the bobbin means 168 is depicted as comprising a generally cylindrically tubular intermediate portion 170 formed integrally at one end with a generally outwardly radiating annular flange portion 172, which is generally perpendicular to the axis 174 of bobbin 168, and, at its end opposite to said one end, formed integrally with a generally rectangular body portion 176 which is also generally perpendicular to the axis 174. A generally cylindrical passage 178 extends through intermediate cylindrical portion 170 and through both ends; however, as shown in both FIGS. 11 and 12, the end of the passage 178, generally radially inwardly of flange 172, is formed to be annular and of increased cross-sectional thickness thereby defining an annular shoulder-like portion 180 having an annular abutment surface 182.

The bobbin 168 is preferably molded of suitable plastic material and one of such is "Zytel". "Zytel" is a United States of America trademark, of Du Pont de Nemours, E.I. & Co., of Wilmington, Del., U.S.A., for a nylon resin commercially available as a molding powder and extrusion powder.

Figure 12:
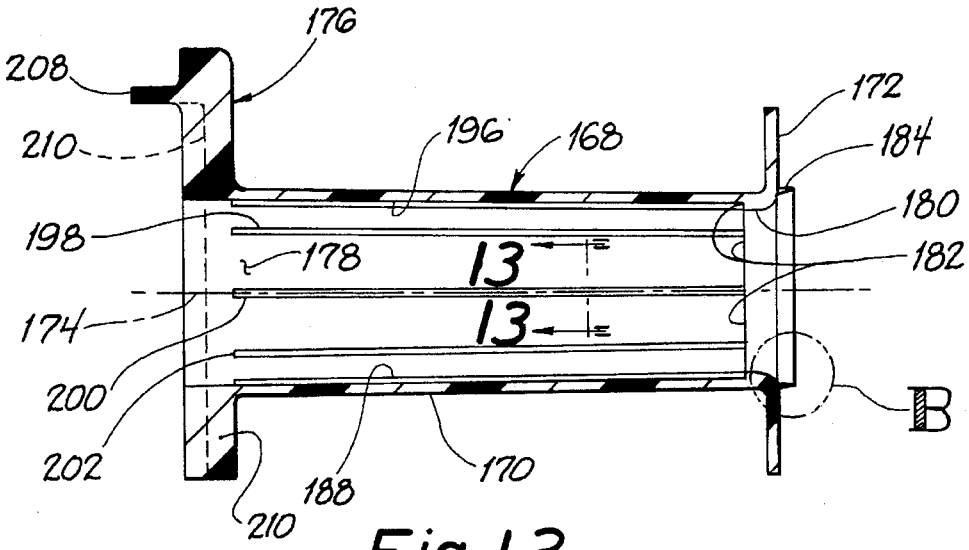
FIG. 12 is an axial cross-sectional view taken generally on the plane of line 12—12 of FIG. 11 and looking in the direction of the arrows.
Figure 14:
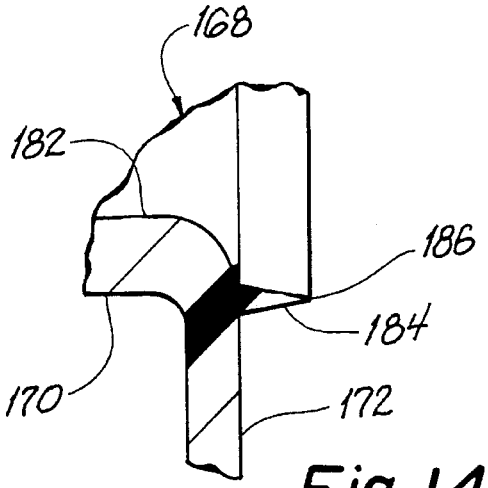
FIG. 14 is also a still further relatively enlarged view of a fragmentary portion of the structure of FIG. 12 and as appears generally within circle B of FIG. 12.

Referring primarily to FIGS. 12 and 14, the bobbin 168 is preferably comprised of an integrally molded generally circular axially outwardly projecting fin-like portion 184 which, as best seen in FIG. 14, is preferably of cross-sectionally tapered thickness as to at least approach a cross-sectionally triangular configuration with an apex end 186. The thickness and configuration of circular fin 184 is such as to exhibit a degree of resilient deformation when a force is applied thereagainst.

Figure 13:
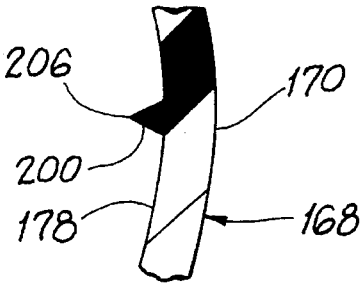
FIG. 13 is a still further relatively enlarged view of a fragmentary cross-sectional portion taken generally on the plane of line 13—13 of FIG. 12 and looking in the direction of the arrows.
Figure 17:
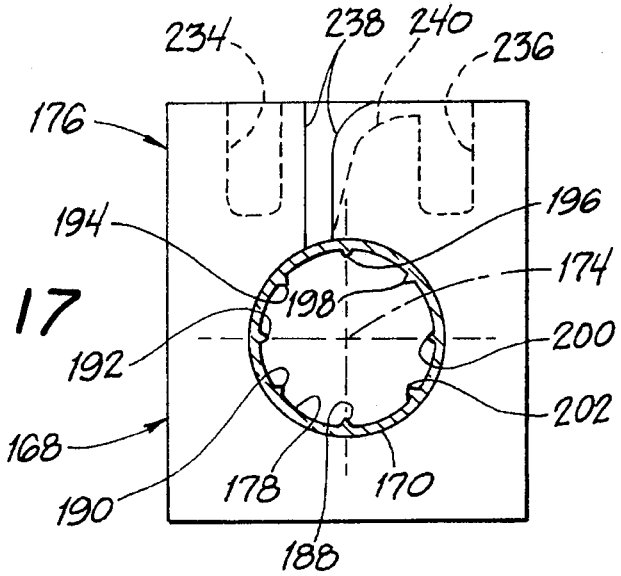
FIG. 17 is a cross-sectional view taken generally on the plane of line 17—17 of FIG. 11 and looking in the direction of the arrows.

Referring primarily to FIGS. 12, 13 and 17, in the preferred embodiment, the bobbin 168 has a plurality of generally equidistantly angularly spaced ribs or fins 188, 190, 192, 194, 196, 198, 200 and 202 integrally formed on and with cylindrical surface 178 in a manner as to extend longitudinally generally parallel to axis 174 and to project radially inwardly of cylindrical surface 178. As typically illustrated in relatively enlarged scale in FIG. 13, such ribs, as depicted by 200, are preferably of triangular cross-sectional configuration and are effective for experiencing some slight degree of resilient deformation as at the respective apexes as at 206.

Figure 7:
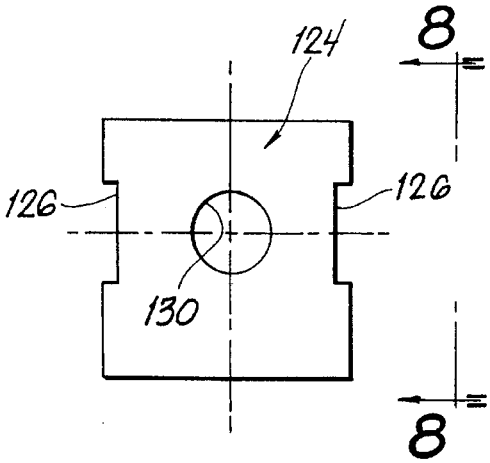
FIG. 7 is an elevational view, of one of the elements of FIG. 5, taken in the direction of arrow A of FIG. 5.
Figure 8:
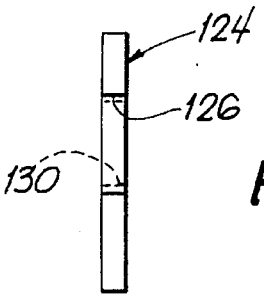
FIG. 8 is a view taken generally on the plane of line 8—8 of FIG. 7 and looking in the direction of the arrows.
Figure 15:
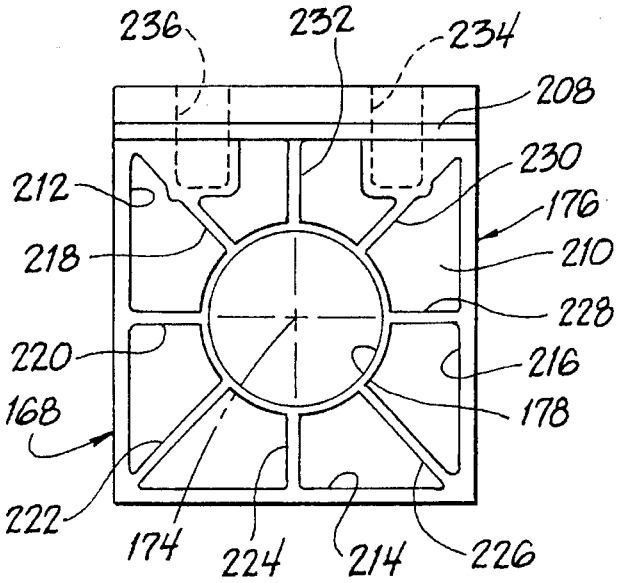
FIG. 15 is a view taken generally on the plane of line 15—15 of FIG. 11 and looking in the direction of the arrows.
Figure 16:
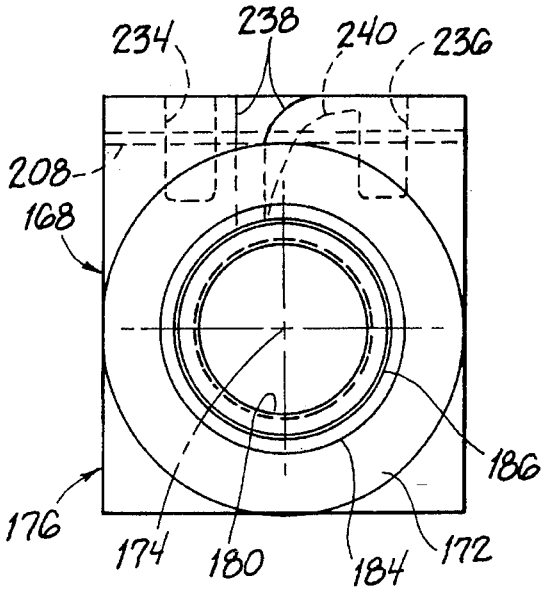
FIG. 16 is a view taken generally on the plane of line 16—16 of FIG. 11 and looking in the direction of the arrows.

Referring primarily to FIGS. 11, 12, 15, 16 and 17 the end body portion 176 is provided with an integrally formed flange or ledge 208 against which, as will be evident, the end plate 124, FIGS. 7 and 8, may abut. Further, as best seen in FIGS. 12 and 15, the main body 210 of end portion 176 is preferably provided with a series or system of integrally formed reinforcing ribs 212, 214, 216, 218, 220, 222, 224, 226, 228, 230 and 232.

Figure 5:
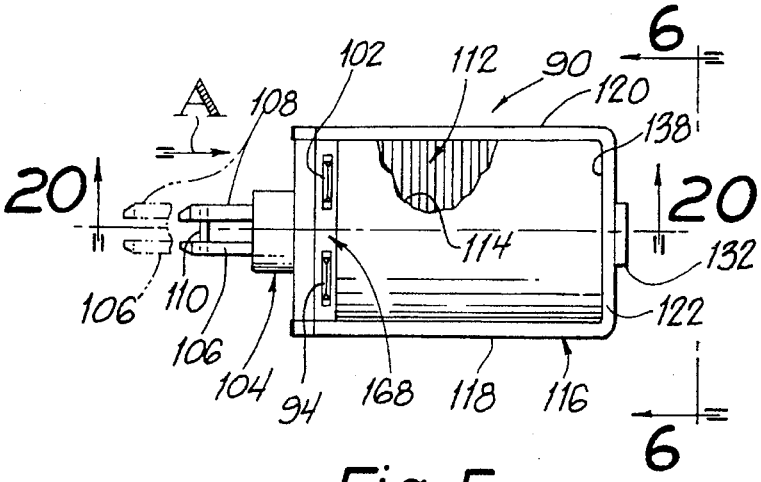
FIG. 5 is a top plan view of one of the assemblies, shown in FIGS. 3 and 4, and employing teachings of the invention.
Figure 6:
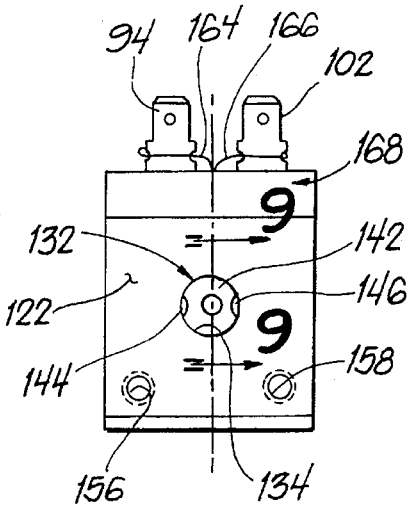
FIG. 6 is a view taken generally on the plane of line 6—6 of FIG. 5 and looking in the direction of the arrows.

As shown in FIGS. 11, 15, 16 and 17, the end body portion 176 has formed therein pockets, slots or recesses 234 and 236 for the respective reception therein of electrical terminals 94 and 102, respectively (FIGS. 3, 5 and 6). Further, in the preferred embodiment of the bobbin 168, a slot-like passage 238 is formed in end body 176 in a manner also defining an inner slot or recess 240. The passage 238 and recess 240 enable the placement therein and therethrough of the electrical leads, from opposite ends of the field coil, for respective connection to the terminals received by 234 and 236. Such passage 238 and recess 240 serve to minimize, if not totally prevent, such field coil leads to be too severely bent and thereby possibly mechanically (and electrically) fail.

Figure 18:
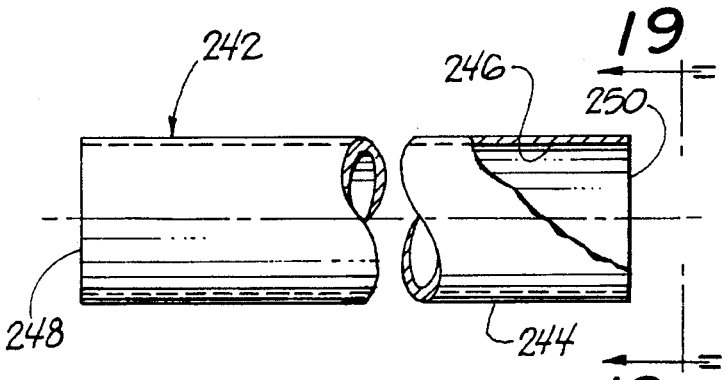
FIG. 18 is an elevational view, in relatively enlarged scale and with portions thereof broken away of still another element of the structure of FIGS. 5 and 6.
Figure 19:
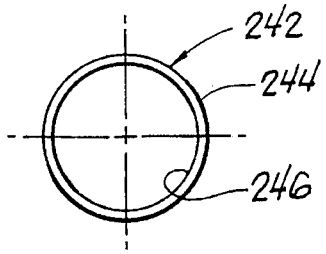
FIG. 19 is a view taken generally on the plane of line 19—19 of FIG. 18 and looking in the direction of the arrows.

FIGS. 18 and 19 illustrate a cylindrical tubular member 242, preferably formed of brass, and, as will become apparent, serving in the main as a sleeve. As shown, the sleeve 242 comprises an outer cylindrical surface 244, an inner cylindrical surface 246 and axially oppositely disposed ends 248 and 250.

Figures 20, 21:
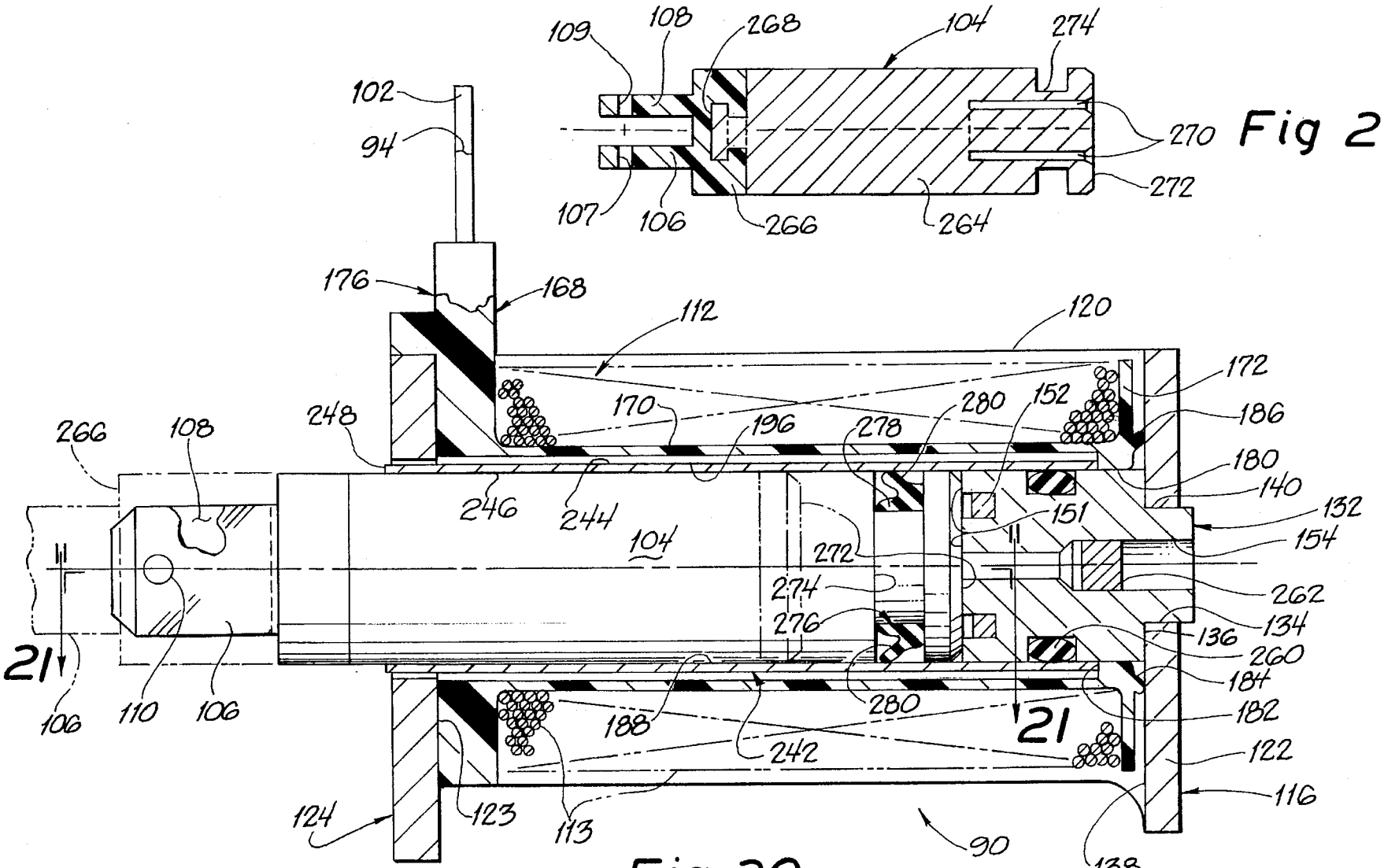
FIG. 20 is a still further relatively enlarged view taken generally on the plane of line 20—20 of FIG. 5 and looking in the direction of the arrows.
FIG. 21 is an axial cross-sectional view, of relatively reduced scale, of one of the elements shown in FIG. 20, and taken generally on the plane of line 21—21 of FIG. 20 and looking in the direction of the arrows.

FIG. 20, in a relatively most enlarged scale, is a view taken generally on the plane of line 20—20 of FIG. 5, and looking in the direction of the arrows, and illustrating the various elements and/or details already described or referred to in an assembled condition thereby comprising the electro-fluid actuator 90.

As previously indicated with regard to FIG. 5, the electrical field coil means 112 comprises the bobbin means 168 and the energizable field coil 113 wound on and about the intermediate cylindrical tubular portion 170 and axially between and contained by flange 172 and end body 176. As generally depicted, the overall length of the bobbin 168 is preferably such as to be some slight amount greater than the distance between the inside surface 138 of U-frame wall 122 and the inside surface 123 of the plate member 124. As a consequence, the fin or rib 184 is caused to undergo some degree of resilient deformation thereby assuring a desired tight fit, axially, as between bobbin 168 and the flux conducting frame assembly including plate 124.

The sleeve 242 (of FIGS. 18 and 19) is received in the cylindrical tubular portion 170 of bobbin 168 in a manner whereby, preferably, the outer cylindrical surface 244 of sleeve 242 is somewhat tightly accommodated by the plurality of rib-like portions or projections 196, 188 (and others as shown in FIGS. 12, 13 and 17). The sleeve 242 is axially inserted until its right end (as viewed in FIG. 20) abuts against annular shoulder or abutment surface 182 (also shown in FIGS. 11 and 12).

Still referring primarily to FIG. 20, and to FIGS. 9 and 10, the generally cylindrical stop member 132 has its outer cylindrical surface 133 received within and against annular surface 180, of bobbin 168, while its smaller cylindrical surface 140 is closely received in aperture or passage 134 of frame end wall 122. Also, the annular recess or groove 148 (FIG. 9) carries an O-ring seal 260 which effectively creates a fluid seal as between stop member 132 and inner cylindrical surface 246 of sleeve 242. In the preferred embodiment, a selectively porous member 262 is fixedly inserted into passage means 154 so as to provide thereacross a preselected volume rate of fluid flow for a preselected pressure differential thereacross. Such member 262 may be considered as comprising calibrated flow restriction means and, at the same time, minimizing the opportunity for foreign matter to pass from ambient and into the chamber or space generally occupied by the actuator or armature means 104.

Referring to FIG. 21, the actuator shaft or armature means 104 is shown as preferably comprising a generally cylindrical member having a first major portion 264 comprised of magnetically responsive steel and a relatively smaller second portion 266 comprised of suitable plastics material molded onto a head-like end 268 of the major portion 264. Passages 107 and 109, respectively in arms 106 and 108, cooperatingly receive and retain pin like member 110. The major body portion 264 may have formed, into the end 272 thereof, a generally circular recess 270 which, if desired may receive a portion of a spring therein and serve as a spring perch therefor. In the embodiment disclosed, as in FIGS. 1, 2, 3 and 4, the spring function is provided in the overall system or arrangement and takes the form of the torsion spring 88 of FIG. 3. An annular groove or recess 274 is also formed into and about portion 264 and is effective for receiving therein seal means 276 (FIG. 20). In the preferred embodiment, the seal 276 is comprised of an annular main body 278, held within the groove 274, and an integrally formed relatively flexible or deflectable annular lip 280 which is in contact with the inner cylindrical surface 246 of sleeve 242. Further, in the preferred embodiment of the invention, the end 272 of actuator rod or armature 104 is formed to be of a convex generally spherical surface having a radius of formation in the order of 10.5 inches swung as from the axis 115 of actuator or armature 104. Such a configuration of end surface 272 will prevent a tendency for the end 272 to lock against the end surface 151 of stop 132.

OPERATION OF EMBODIMENT OF FIGS. 1–21

As already generally indicated, the electro-fluid actuator assembly 90 will attain-two extreme positions in its operation.

Generally, referring to FIGS. 1, 2, 3 and 4, when switch 46 is electrically open, there is no electrical energization of field coil 113 and, as part of the overall system, torsion spring 88 (FIG. 3) keeps the ice dispensing door 48 closed and in so doing has caused the lever 86 to have moved, via contact with pin 110, the actuator rod or armature means 104 to its corresponding position projecting outmost of the electro-fluid actuator assembly 90. Such outmost position of the armature or actuator means 104 is, for purposes of illustration and description, depicted by phantom lines indicating end face 272 and portions 266 and 106 in FIG. 20.

Assuming now that switch 46 is made closed, when the ice dispenser door 48 is closed, the field coil 113 will become electrically energized causing the actuator or armature means 104 to move from its previously described position outmost of assembly 90 and towards the right, as viewed in either FIGS. 4 or 20, until end surface 272 abuts against stop surface 151 of stop member 132. During such movement the trapped lever 86 is caused to rotate counterclockwise thereby rotating shaft portions 78 and 80 (as viewed in FIG. 4) causing the ice dispenser door 48 to be moved in unison therewith and thereby open the lower end of passage 50 for the ice to be dispensed therethrough. Such opening movement of the ice dispensing door 48 and corresponding movement of the actuator or armature means 104 is resiliently restrained by the torsion spring 88 employed in the system. In practicing the invention, resilient or spring means could be provided as to form, for example, a part of the overall assembly 90; however, such is not necessary when the overall system comprising the assembly 90 employs a spring which can provide the necessary resilient feed-back to the assembly 90.

In the embodiment disclosed, passage 154 is in communication with ambient atmosphere. Assuming again the condition wherein the ice dispenser door 48 is closed and the actuator or armature means 104 is most extended out of assembly 90 (assuming positions generally depicted by phantom lines 272, 266 and 106) a substantial chamber exists within sleeve 242 and axially between end 272 of armature 104 and opposed face or surface 151 of stop member 132. At this time such chamber most probably contains ambient atmosphere. If now, because of the energization of field coil 113, actuator or armature 104 is caused to move in a direction whereby armature face 272 will abut against surface 151, the volume of ambient atmosphere in the chamber fairly freely passes past the deflectable seal lip 280 thereby bringing about a relatively rapid movement of armature means 104 towards and against stop member 132 and such relatively rapid movement is also experienced by lever or arm 86 (FIG. 4), counter-clockwise rotation of shaft 78 (FIG. 4) and ultimately by the relatively rapid opening of the ice dispensing door 48.

If now it is assumed that: (a) end 272 of actuator or armature 104 is against surface 151 of stop member 132; (b) ice dispensing door 48 is in its opened position and (c) switch 46 is then made electrically open, the only available force for closing the ice dispenser door 48 and for moving the armature or actuator to its position most extended from assembly 90, is the resilient force provided by the torsion spring 88. During such a condition of travel, the relatively flexible lip 280 of seal 276 moves outwardly against the inner cylindrical surface 246 of sleeve 242 effectively creating a moving fluid seal with the consequence that in order to fill the chamber being created between, generally, the end 272 of armature 104 and surface 151 of stop 132, ambient air must be drawn through the passage 154 and calibrated restriction 262 and because of such preselected restriction to ambient flow, the speed of movement of actuator or armature is made considerably less than the speed at which the actuator 104 moves in opening the ice dispenser door 48.

Consequently, the invention provides means whereby the ice dispenser door 48 can be opened fairly quickly to obtain the dispensing of ice through passage 50 and yet provide for a relatively slower closing of such ice dispensing door as to prevent any pieces of ice which may be moved through aperture 42 by reason of motor and conveyer inertia (even though switch 46 has been opened) to be caught within passage means 50 by virtue of having the dispenser door 48 close too quickly and thereby giving rise to the distinct possibility of such trapped or caught pieces of ice somewhat melting and re-freezing within the passage 50 causing an undesirable blockage therein.

Further, in the preferred embodiment, and especially where the electrical power employed is a.c., the copper ring 152 is provided in order to function as a "shading ring" to the armature 104 so as to result in a slight lag in the field collapse in part of the armature rod 104 thereby eliminating any "hum" or "buzz" which results from armature movement occurring each time the supplied a.c. current goes through zero.

FIGS. 22, 23, 24 and 25 illustrate in somewhat simplified form other embodiments and modifications of the invention. In FIGS. 22–25, only that much of the structure is shown as is needed to illustrate and disclose the general operation thereof.

Figure 22:
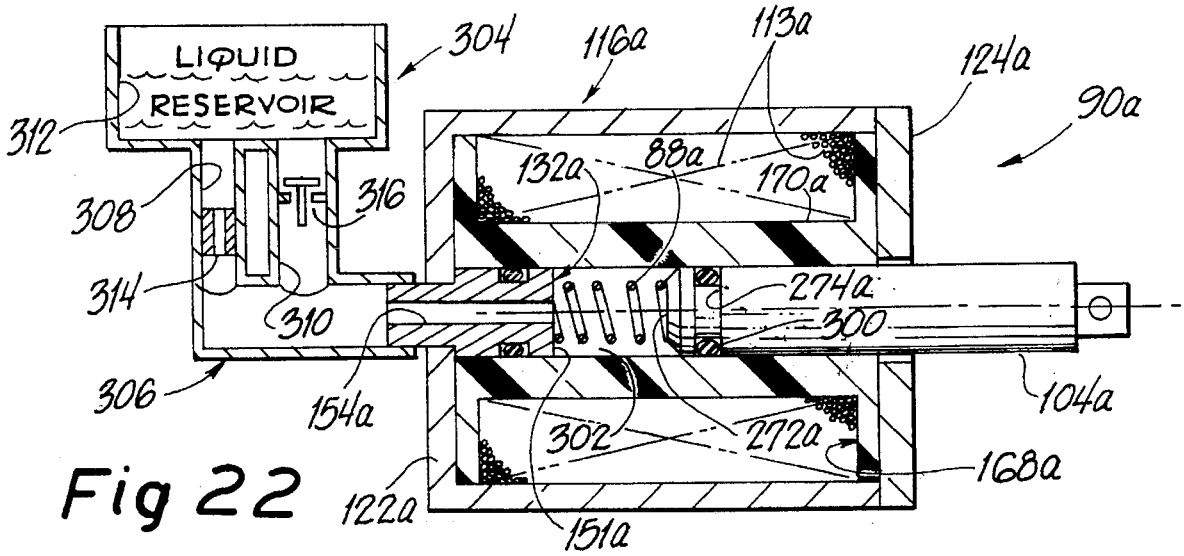

Referring in greater detail to FIG. 22 wherein elements which are like or similar to those of FIGS. 1–21 are identified with like reference numerals provided with a suffix "a" the actuator or armature means **104*a* is preferably provided with an O-ring seal 300 instead of the cup-like lip seal 276 of FIG. 20. The passage 154*a* and variable chamber 302 (which exists generally between stop 132*a* and end 272*a* of armature 104*a*) are in communication with liquid reservoir means 304 as via conduit means 306 which may comprise conduit portions 308 and 310 both shown in communication with the chamber 312 of reservoir means 304. Conduit portion 308 is shown provided with calibrated flow restriction means 314 while conduit portion 310 is shown provided with a flow check valve 316 permitting flow through conduit portion 310 and into reservoir chamber 312 but preventing flow from chamber 312 and through conduit portion 310**. The reservoir may contain a supply of any suitable liquid as for example, water or oil.

In FIG. 22 when the field coil **113*a* is energized, armature means 104*a* moves toward stop member 132*a* and in so doing pushes the liquid from chamber 302 through passage 154*a* and conduit means 306. A small portion of such liquid may flow through restriction 314; however, most of such liquid will flow past or through check valve 316 and into reservoir 312**.

When the armature **104*a* is at its left-most position (as viewed in FIG. 22) and the field coil 113*a* is then de-energized, spring means 88*a* serves to move armature or actuator 104*a* to the right. Such rightward movement of armature 104*a* develops a pressure differential from the reservoir side of restriction 314 to expanding chamber 302 thereby causing flow of liquid through restriction 314 which, in turn, limits the rate of liquid flow therethrough and into chamber 302 as to thereby slow the speed of rightward movement of armature or output shaft means 104*a*. Consequently, the normal speed of movement of armature 104*a* to the left (as viewed in FIG. 22) is relatively faster and the normal speed of movement of armature 104*a* to the right (as viewed in FIG. 22**) is relatively slower.

Figure 23:
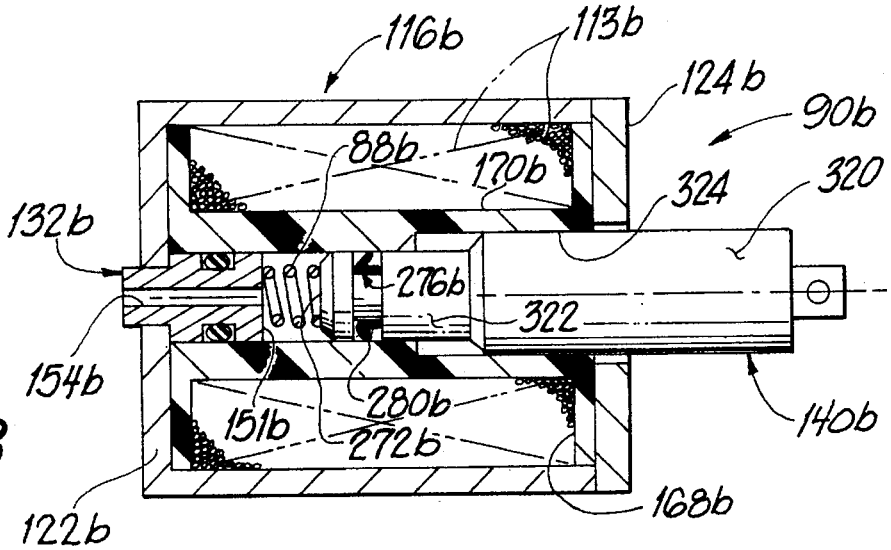

In the embodiment of FIG. 23, all elements which are like or similar to those of FIGS. 1–22 are identified with like reference numerals provided with a suffix "b". In the main, it can be seen that the armature or actuator **104*b* is comprised of stepped cylindrical body portions 320 and 322 and that the passage 324 formed centrally of and through bobbin 168*a* is of a complementary configuration. In the embodiment of FIG. 23, just as in FIG. 20, when the field coil 113*b* is energized the armature 104*b* moves to the left (as viewed in FIG. 23) and in so doing the sufficiently flexible lip 280*b* permits fluid to pass by it thereby enabling the armature 104*b* to move at a speed relatively fast, to the left. However, when the armature 104*b* is at its left-most position and energization of field coil 113*b* is terminated, spring means 88*b* starts to move armature 104*b* to the right (as viewed in FIG. 23). As such rightward movement of armature 104*b* starts, the annular lip 280*b* of annular seal 276*b* is forced against the cylindrical inner surface of the cooperating passage in sealing relationship therewith. As a consequence fluid is drawn through calibrated restriction means 154*b* and the initial speed of movement of armature 104*b* is relatively slow and controlled by the restricted rate of flow of fluid through calibrated restriction passage means 154*b* into the chamber generally between 272*b* and 151*b*. Such relatively slow movement of armature means 104*b* continues until the annular seal 276*b* is brought into the relatively enlarged passage portion which accommodates the relatively diametrically enlarged body portion 320 of armature 104*b*. At that time the seal 276*b* ceases to provide a sealing function, as with respect to passage 324, and the speed of movement of armature 104*b*** is increased over that speed experienced in its initial movement to the right.

Figure 24:
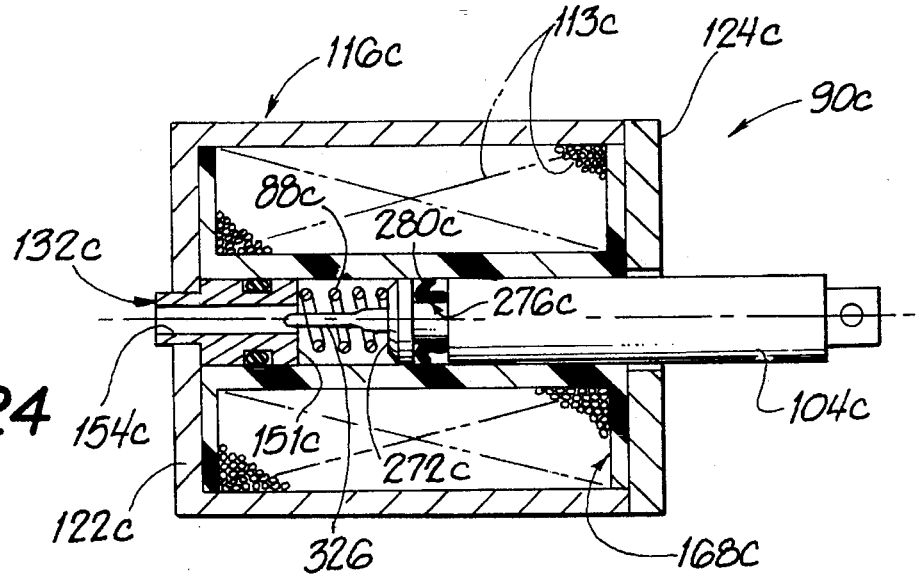

In FIG. 24 all elements which are like or similar to those of FIGS. 1–23 are identified with like reference numerals provided with a suffix "c". As with regards to, for example, FIG. 20, when the field coil **113*c* is energized armature 104*c* moves to the left (as viewed in FIG. 24) with lip 280*c* of annular seal 276*c* permitting fluid flow therepast and having armature 104*c* move to the left at a relatively fast speed. When the armature 140*c* is at its left-most position a selectively contoured needle valve 326, or the like, is at least to some degree received within passage 154*c***. With armature 104*c* in its left-most position and with contoured needle valve 326 being received by passage 154*c*, when field coil 113*c* is then de-energized, spring 88*c* starts to move armature 104*c* to the right and, as previously described, the annular lip 280*c* of annular seal 276*c* is held in sliding sealing relationship with the passage receiving armature 104*c*. The speed of movement of armature 104*c* to the right (as viewed in FIG. 24) will be controlled by the resistance to flow of fluid through passage 154*c* and past contoured needle valve 326 cooperating with passage 154*c* in creating variably controlled or defined fluid flow restriction means. Therefore, by way of example, the initial speed of movement to the right by armature 104*c* may be relatively slow and then increase in speed to either another generally constant magnitude or even continually progressively increase in its speed in the rightward direction.

Springs 88*a*, 88*b* and 88*c* have been, as a convenience, illustrated as being generally within the respective assemblies 90*a*, 90*b* and 90*c* and such may actually be the case in practicing the invention. However, it should now be clear that such reactive spring means may be provided generally outwardly of the assembly (90*a*, 90*b* or 90*c*) and operatively connected, directly or indirectly, to the armature means (104*a*, 104*b* or 104*c*).

Figure 25:
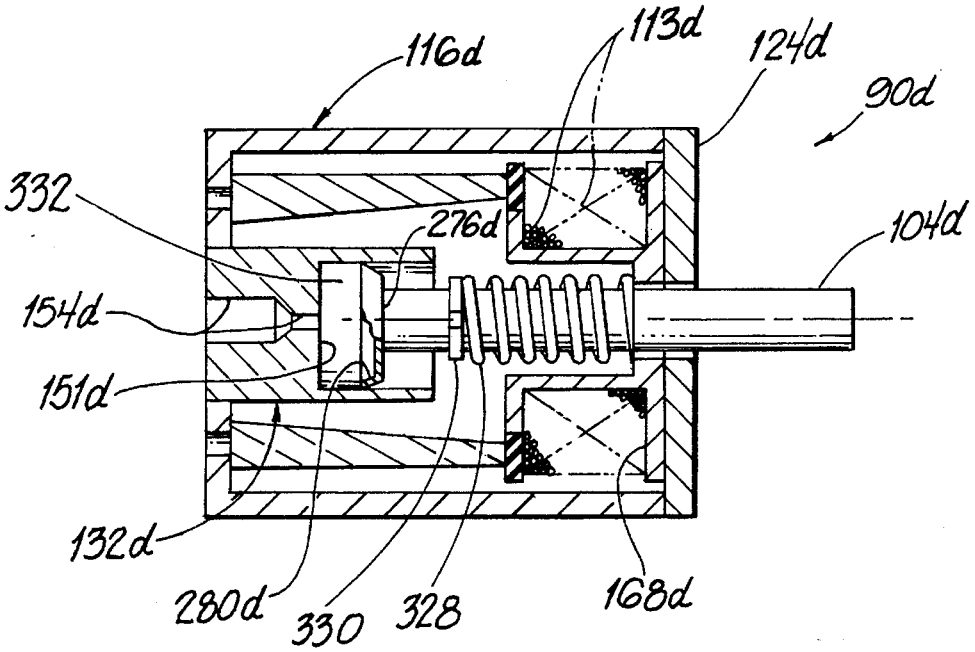
FIGS. 22, 23, 24 and 25 each generally axially cross-sectional views, respectively depict other embodiments or modifications of the invention.

In FIG. 25, all elements which are like or similar to any of those in FIGS. 1–24 are identified with like reference numerals provided with a suffix "d". Referring in greater detail to FIG. 25, the armature means 104*d* is shown having a coiled compression spring 328 thereabout and axially contained as by having its right-most end (viewed in FIG. 25) operatively abutting a portion of the spool 168*d* and its other end abutting a clip 330, or the like, carried by armature 104*d* and serving as a spring perch or abutment. When the field coil 113*d* is energized, armature 104*d* moves to the right against the resilient resistance of spring 328 and, during such movement, the generally flexible annular lip 280*d* of annular, or cup-like, seal 276*d* permits the relatively free flow of fluid (as for example ambient air) past the lip 280*d* and into chamber 332 generally between surface 151*d* and annular seal 276*d*. Such rightward movement of armature 104*d* may be considered as being at a relatively high speed. When armature 104*d* is in its right-most position and the field coil 113*d* is de-energized, spring 328 will move armature 104*d* to the left (viewed in FIG. 25) and the speed of such leftward movement will be controlled by the rate of flow of fluid out of chamber 332 and through calibrated flow restriction means 154*d*. This flow of fluid is brought about by the annular or cup-like seal 276*d* forcing the fluid out of chamber 332 as the spring biased armature 104*d* moves the cup-shaped seal 276*d* toward surface 151*d*. Such restricted outflow of fluid produces a relatively slow speed of return of armature 104*d* upon de-energization of field coil means 113*d*.

Figures 26, 27, 28:
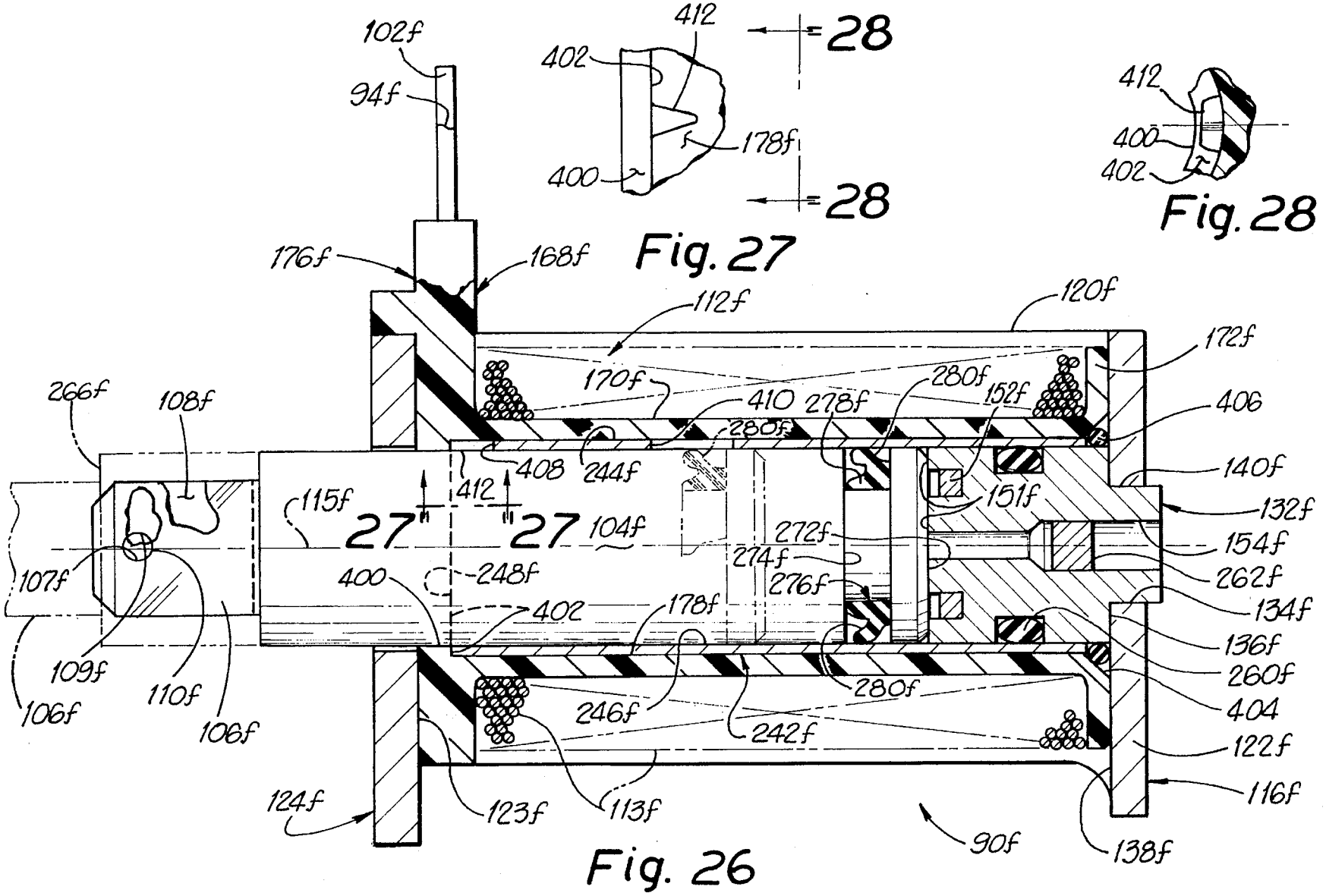
FIG. 26 is a view similar to that of FIG. 20 but illustrating a modification of the invention shown in FIG. 20.
FIG. 27 is a view, of a fragmentary portion of the structure shown in FIG. 26, taken generally on the plane of line 27—27 of FIG. 26 and looking in the direction of the arrows.
FIG. 28 is a view taken generally on the plane of line 28—28 of FIG. 27 and looking in the direction of the arrows.

In FIG. 26 all elements which are like or similar to those of FIGS. 1–20, except as noted to the contrary, are identified with like reference numerals provided with a suffix "f".

Generally, in comparing the structures of FIGS. 20 and 26, it can be seen that in the preferred embodiment of the modification of FIG. 26, the bobbin 168*f* does not employ the longitudinal ribs 188, 190, 192, 194, 196, 198, 200 and. 202 of FIG. 20 but, instead, somewhat closely, slidably receives the sleeve 242*f* in and against the inner cylindrical surface or passage 178*f* of bobbin intermediate portion 170*f*. Further, in the preferred form of the embodiment of FIG. 26, the left end (as viewed in FIG. 26) of bobbin 168*f* is provided with a collar or shoulder-like annular portion which has an inner cylindrical surface 400 of a diameter dimensionally less than the diameter of inner cylindrical surface 178*f* and yet greater than the outer diameter of armature means 104*f* as to enable the free movement of armature 104*f* with respect to surface 400. A radially directed annular surface 402, generally, interconnects inner cylindrical surfaces 400 and 178*f* and serves as an abutment means for the left end (as viewed in FIG. 26) 248*f* of sleeve 242*f*.

That is, in the embodiment of FIG. 20, the sleeve 242 was inserted into the passage means 178 of the bobbin 168 from the left end (as viewed in FIG. 20) and pushed axially inwardly until it abutted against the annular abutment surface 182 of the bobbin 168. In comparison, at assembly, in FIG. 26 the sleeve 242*f* is inserted from the right end of bobbin 168*f* and pushed axially inwardly until end 248*f* of sleeve 242*f* abuts against abutment means 402. In order to enable this, the bobbin 170*f* does not have the portions 180, 182, 184 and 186 of the embodiment of FIG. 20 and, instead, has the right end (as viewed in FIG. 26) of the bobbin 168*f* open to the degree permitting sleeve 242*f* to pass therethrough. The end of bobbin 168*f* is preferably provided with a generally conical surface 404 which provides sufficient space for the reception of an O-ring seal 406. When the flux conducting body or housing 116*f* is assembled to the other already assembled elements, the inner surface 138*f* of wall portion 122*f* compresses O-ring seal 406 against conical surface 404 and against end 250*f* of sleeve 242*f* thereby assuring assembled stability of the embodiment of FIG. 26.

The sleeve 242*f* of FIG. 26 is also shown in FIGS. 29 and 30. As possibly best seen in FIG. 29, the sleeve 242*f* is provided with a notch or recess 408 formed into and through the end 248*f*. Further, the sleeve 242*f* also has a relatively narrow elongated opening or passage 410 formed through the wall of the sleeve 242*f*. The notch, cut-out or recess 408 serves to operatively receive a keying portion 412 carried by the bobbin 168*f* and, in particular, carried as by the inner surface of the passage means through the bobbin 168*f*. FIG. 27 depicts a possible configuration of such a key or interfering abutment 412 when viewed generally along the line of 27—27 of FIG. 26, in the direction of the arrows, and with the armature means 104*f* and sleeve 242*f* removed.

FIG. 28 is a relatively enlarged fragmentary view taken generally on the plane of line 28—28 of FIG. 27 and looking in the direction of the arrows. This recess 408 and key 412 are provided, in the main, as to prevent attempting the assembling of sleeve 242*f* into the bobbin 168*f* in a manner whereby end 250*f*, of sleeve 242*f*, is attempted to be made seated against abutment 402. In the absence of such a key or abutting portion 412, the sleeve 242*f* could be inserted as to have end 250*f* abut against surface 402; however, this could, and most probably would, result in having passage or vent 410 be improperly positioned axially along the assembly 90*f*.

The use of the recess 408 and keying or abutting means 412 eliminates the possibility of misassembly of the sleeve 242*f* to the bobbin 116*f* as hereinbefore described. Accordingly, with the recess 408 and the keying or abutting means 412 being provided, the only way that the sleeve 242*f* can be seated or abutted against surface or abutting means 402 is by inserting sleeve 242*f* into passage 178*f* in a manner whereby end 248*f* is first inserted and the sleeve 242*f* is rotatably positioned, about its axis as to have recess 408 aligned as to receive the keying means 412. As the sleeve 242*f* is moved to its limit, key 412 is received by recess 408 and end 248*f* is abutted against abutment surface means 402.

As previously indicated with regard to FIGS. 5 and 20, the electrical field coil means 112*f* comprises the bobbin means 168*f* and the energizable field coil 113*f* wound on and about the intermediate cylindrical tubular portion 170*f* and axially between and contained by flange 172*f* and end body 176*f*.

Still referring primarily to FIG. 26, the generally cylindrical stop member 132*f* has its outer cylindrical surface 133*f* received within and against inner surface 246*f* of sleeve 242*f*, while its smaller cylindrical surface 140*f* is closely received in aperture or passage 134*f* of flux conducting housing or body end wall 122*f*. Also, the annular recess or groove 148*f* (also see FIG. 9) carries an O-ring seal 260*f* which effectively creates a fluid seal as between stop member 132*f* and inner cylindrical surface 246*f* of sleeve 242*f*. In the preferred form of the embodiment of FIG. 26, a selectively porous member 262*f* is fixedly inserted into passage means 154*f* so as to provide thereacross a preselected volume rate of fluid flow for a preselected pressure differential thereacross. Such member 262*f* may be considered as comprising calibrated flow restriction means and, at the same time, minimizing the opportunity for foreign matter to pass from ambient and into the chamber or space generally occupied by the actuator or armature means 104*f*.

Unlike the actuator shaft or armature means 104 of FIGS. 20 and 21, in the preferred form of the embodiment of FIG. 26, the armature means 104*f* is not comprised of a first major portion as 264 and a second portion 266 comprised of suitable plastics material molded onto a head-like end 268 of the major portion 264. Passages 107*f* and 109*f*, respectively in arms 106*f* and 108*f*, cooperatingly receive and retain pin like member 110*f*. In the embodiment disclosed, as in FIGS. 1, 2, 3 and 4, the spring function may be provided in the overall system or arrangement and takes the form of the torsion spring 88 of FIG. 3. An annular groove or recess 274*f* is also formed into and about portion 264*f* of armature 104*f* and is effective for receiving therein seal means 276*f* (FIG. 26). In the preferred embodiment, the seal 276*f* is comprised of an annular main body 278*f*, held within the groove 274*f*, and an integrally formed relatively flexible or deflectable annular lip 280*f* which is in contact with the inner cylindrical surface 246*f* of sleeve 242*f*. Further, in the preferred form of the embodiment of the invention, the end 272*f* of actuator rod or armature 104*f* may be formed to be of a convex, generally spherical surface having a radius of formation in the order of 10.5 inches swung as from the axis 115*f* of actuator or armature 104*f*. Such a configuration of end surface 272*f* will prevent a tendency for the end 272*f* to lock against the end surface 151*f* of stop 132*f*.

OPERATION OF EMBODIMENT OF FIGS. 26–33

As already generally indicated, the electro-fluid actuator assembly 90*f* will attain two extreme positions in its operation.

Generally, referring to FIGS. 1, 2, 3 and 4, when switch 46 is electrically open, there is no electrical energization of field coil 113*f* and, as part of the overall system, torsion spring 88 (FIG. 3) keeps the ice dispensing door 48 closed and in so doing has caused the lever 86 to have moved, via contact with pin 110*f*, the actuator rod or armature means 104*f* to its corresponding position projecting outmost of the electro-fluid actuator assembly 90*f*. Such outmost position of the armature or actuator means 104*f* is, for purposes of illustration and description, depicted by phantom lines indicating end face 272*f* and portions 266*f* and 106*f* in FIG. 26.

Assuming now that switch 46 is made closed, when the ice dispenser door 48 is closed, the field coil 113*f* will become electrically energized causing the actuator or armature means 104*f* to move from its previously described position outmost of assembly 90*f* and towards the right, as viewed in either FIGS. 4 or 26, until end surface 272*f* abuts against stop surface 151*f* of stop member 132*f*. During such movement of the trapped lever 86 is caused to rotate counter-clockwise thereby rotating shaft portions 78 and 80 (as viewed in FIG. 4) causing the ice dispenser door 48 to be moved in unison therewith and thereby open the lower end of passage 50 for the ice to be dispensed therethrough. Such opening movement of the ice dispensing door 48 and corresponding movement of the actuator or armature means 104*f* is resiliently restrained by the torsion spring 88 employed in the system. In practicing the invention, resilient or spring means may be provided as to form, for example, a part of the overall assembly 90*f*; however, such is not necessary when the overall system, comprising the assembly 90*f*, employs a spring which can provide the necessary resilient feed-back to the assembly 90*f*.

In the FIG. 26 embodiment disclosed, passage 154*f*, by way of example, is shown in communication with ambient atmosphere. Assuming again the condition wherein the ice dispenser door 48 is closed and the actuator or armature means 104*f* is most extended out of assembly 90*f* (assuming positions generally depicted by phantom lines 272*f*, 266*f* and 106*f*) a substantial chamber exists within sleeve 242*f* and axially between end 272*f* of armature 104*f* and opposed face or surface 151*f* of stop member 132*f*. At this time such chamber most probably contains ambient atmosphere. If now, because of the energization of field coil 113*f*, actuator or armature 104*f* is caused to move in a direction whereby armature face 272*f* will abut against surface 151*f*, the volume of ambient atmosphere in the chamber fairly freely passes past the deflectable seal lip 280*f* thereby bringing about a relatively rapid movement of armature means 104*f* towards and against stop member 132*f* and such relatively rapid movement is also experienced by lever or arm 86 (FIG. 4), counter-clockwise rotation of shaft 78 (FIG. 4) and ultimately by the relatively rapid opening of the ice dispensing door 48.

If now it is assumed that: (a) end 272*f* of actuator or armature 104*f* is against surface 151*f* of stop member 132*f*; (b) ice dispensing door 48 is in its opened position and (c) switch 46 is then made electrically open, the only available force for closing the ice dispenser door 48 and for moving the armature or actuator 104*f* to its position most extended from assembly 90*f*, is the resilient force provided by the torsion spring 88. During such a condition of travel, the relatively flexible lip 280*f* of seal 276*f* moves outwardly against the inner cylindrical surface 246*f* of sleeve 242*f* effectively creating a moving fluid seal with the consequence that in order to fill the chamber being created between, generally, the end 272*f* of armature 104*f* and surface 151*f* of stop 132*f*, ambient air must be drawn through the passage 154*f* and calibrated restriction 262*f* and because of such preselected restriction to ambient flow, the speed of movement of actuator or armature 104*f* is made considerably less than the speed at which the actuator 104*f* moves in opening the ice dispenser door 48.

Consequently, among other features and capabilities yet to be discussed, the invention provides means whereby the ice dispenser door 48 can be opened fairly quickly to obtain the dispensing of ice through passage 50 and yet provide for a relatively slower closing of such ice dispensing door as to prevent any pieces of ice which may be moved through aperture 42 by reason of motor and conveyer inertia (even though switch 46 has been opened) to be caught within passage means 50 by virtue of having the dispenser door 48 close too quickly and thereby giving rise to the distinct possibility of such trapped or caught pieces of ice somewhat melting and re-freezing within the passage 50 causing an undesirable blockage therein.

Further, in the preferred form of the embodiment of FIG. 26, and especially where the electrical power employed is a.c., the copper ring 152*f* is provided in order to function as a "shading ring" to the armature 104*f* so as to result in a slight lag in the field collapse in part of the armature rod 104*f* thereby eliminating any "hum" or "buzz" which results from armature movement occurring each time the supplied a.c. current goes through zero.

Still referring to FIG. 26 and remembering that the fit between the main body of armature means 104*f* and the inner cylindrical surface 246*f* of sleeve 242*f* is such as to permit the fairly free flow of fluid therebetween, let it now be assumed that the field coil 113*f* is energized resulting in armature means 104*f* being moved to its depicted solid-line position against stop 132*f* moving ice dispensing door 48 to its opened position.

Now let it be further assumed that switch 46 is made electrically open and that the resilient force provided by spring means 88 causes armature means 104*f* to undergo movement from against stop means 132*f* to its outmost position depicted in phantom line. As already generally explained, during such a condition of travel, the relatively flexible lip 280*f* of seal 276*f* moves outwardly against the inner cylindrical surface 246*f* of sleeve 242*f* effectively creating a moving fluid seal with the consequence that in order to fill the chamber being created between, generally, the end 272*f* of armature 104*f* and surface 151*f* of stop 132*f*, ambient air must be drawn through the passage 154*f* and calibrated restriction 262*f* and because of such preselected restriction to ambient flow, the speed of movement of actuator or armature is made considerably less than the speed at which the actuator 104*f* moves in opening the ice dispenser door 48*f*. This, however, only partially describes the movement of actuator or armature means 104*f* in its travel from its position against stop 132*f* to its outmost position.

The speed of movement of actuator means 104*f* is augmented or modified as it moves toward its outmost position. That is, as actuator means 104*f* moves to the left (as viewed in FIG. 26) the lip 280*f* of seal 278*f* stays against inner cylindrical surface 246*f* of sleeve 242*f*. However, when armature means 104*f* has moved sufficiently to the left, the relatively flexible lip 280*f* of seal 278*f* starts to traverse the axially elongated slot 410 with the result that fluid (from between armature means 104*f* and sleeve 242*f*), using the slot 410 as a path, generally freely flows around that portion of the seal lip 280*f* which is traversing the slot 410. Consequently, this reduces the restriction to the flow of fluid into the chamber (axially between armature means 104*f* and stop 132*f*) resulting in the comparative increase in speed of movement of armature means 104*f*. In the preferred embodiment (sleeve 242*f* also being shown in FIGS. 29, 30 and 31), the slot or path 410 is located so that the increase in speed of movement of armature means 104*f* occurs near and at the end of the stroke of armature means 104*f*; i.e., toward and at its axially outmost position as depicted in FIG. 26.

In the preferred embodiment of the invention as depicted, for example, in FIG. 26, the relatively rapid speed of the armature means 104*f*, provided by slot or path 410, as near its end of travel results in the fast (or faster) closure of ice door 48. Such, in turn, assures that the ice door 48 is fully closed and not held partially open by undue friction or overall system misalignment as may result during production and assembly of the various linkages, journals, spring and other elements comprising as generally depicted in FIGS. 1, 2, 3 and 4. Also, should any ice be at the aperture of ice door 48, such ice is pushed away by the door 48 and the relatively higher velocity of the door 48 during its final closure movement provides additional kinetic energy at that critical time of closure.

In each of FIGS. 31, 32 and 33 the fragmentary portion of the armature means depicted in phantom line and identified as 104*f*-A is meant to represent the position of the armature means against stop means (as 132*f* of FIG. 26) while the fragmentary portion, also depicted in phantom line, identified as 104*f*-B is meant to represent the position of the armature means at its axially outmost position (as corresponding to 266*f* of FIG. 26).

As previously indicated, FIG. 31 somewhat simplistically depicts a portion of the embodiment of FIG. 26 showing how the armature or actuator means, starting from its 104*f*-A position moves to its 104*f*-B position and in so doing moving at a relatively slow speed until the lip 280*f* of seal 278*f* starts to traverse slot or path 410 resulting in the increase in the rate of fluid flow and having the armature means significantly increase its speed of movement as the lip 280*f* starts to traverse path 410 at its right end (as viewed in FIGS. 26, 29 and 31) and continues such traverse to almost the left end of path 410.

FIG. 32 illustrates a modification of the sleeve 242*f* which, if employed in the assembly of FIG. 26 instead of the sleeve 242*f* shown therein, would bring about a modification in the operation of the assembly of FIG. 26 and any end member, such as ice door 48, positioned in response to positions of the armature means.

In particular, referring to FIG. 32, the modified sleeve 242*f* does not include the slot or path 410 as positioned in the embodiment of FIG. 31. Instead, the sleeve 242*f* of FIG. 32 has a slot, passage or path 410-1 formed therein and axially positioned as to be, for purposes of exemplary illustration, generally axially between the actuator means or armature means when at its position identified at 104*f*-A and when at its position identified at 104*f*-B.

In the embodiment of a modified sleeve 242*f* as shown in FIG. 32 and if employed in the structure of FIG. 26 as to be employed therein instead of sleeve 242*f* and slot 410, during ice door 48 closure motion the actuator or armature means 104*f*-A starts to move axially to the left (as viewed in FIG. 32) and during the first portion of such movement, the relatively flexible lip 280*f* effectively engages the inner surface 246*f* of sleeve 242*f*. Such creates an axially moving fluid seal preventing any fluid available to the left of seal lip 280*f* to pass by the seal 276*f* and to chamber space between end 272*f* of armature 104*f*-A and juxtaposed abutment or stop means 132*f* (FIG. 26). This then means that the flow of fluid being permitted into such chamber space is that rate which is permitted by the calibrated restriction means 262*f* of FIG. 26. Consequently, the initial portion of axial movement of the armature means from its position 104*f*-A toward its ultimate full stroke position depicted at its position 104*f*-B is relatively slow and controlled by restriction means 262*f*.

However, when the armature means has moved sufficiently leftward (as viewed in FIG. 32) from its depicted position at 104*f*-A of FIG. 32, the relatively flexible lip 280*f* of seal 276*f* approaches the right end of slot 410-1 and starts to traverse the slot, recess or path 410-1 and in so doing permits augmenting fluid to flow into the path 410-1, with such flow being generally radially outwardly of and around the traversing lip 280*f* and into chamber space axially subsequent to surface 272*f*. Such increased fluid flow via 410-1 (as already explained with regard to FIGS. 26, 29 and 31) results in a significant increase in the speed of movement (to the left as viewed in either FIGS. 26 or 32) of the armature means. Such an increase in speed of movement of armature means continues as the lip 280*f* traverses the slot or path 410-1. When the seal lip 280*f* has completely traversed path 410-1 and continues its movement beyond the left end of slot or path 410-1, the relatively flexible sealing lip 280*f* again is in sealing relationship with the interior of sleeve 242*f* (FIG. 32) resulting in the speed of movement of the armature means, from the point at where lip 280*f* stopped traversing path 410-1 to the axial location corresponding to its outmost stroke, being again comparatively slow and controlled by the fluid flow through calibrated flow restriction means 262*f* (FIG. 26).

Referring now to the embodiment of FIG. 33 it can be seen that instead of the slot 410 (of FIGS. 26, 29 and 31) and slot 410-1 (of FIG. 32), a plurality of slots as depicted generally by slots 410-2 and 410-3 are provided. In considering the embodiment represented in FIG. 33, it can again be seen that shortly upon the movement to the left (viewed in FIG. 33) of the actuator or armature means from its 104*f*-A position, the relatively flexible lip 280*f* of seal 276*f* starts to traverse slot, recess or path 410-2 thereby enabling the relatively free flow of fluid through path 410-2 (left-to-right) about that portion of lip 280*f* traversing recess 410-2 and consequently causes (the previously explained) increase in the speed of movement of the armature means. The increased speed continues until path 410-2 has been traversed by seal 276*f* and the lip 280*f* thereof starts to axially traverse that portion 420 of sleeve 242*f* shown generally between recesses or slots 410-2 and 410-3. As seal lip 280*f* traverses sleeve portion 420, the speed of movement of the armature means, again, is relatively slow as determined by the rate of flow of fluid through the calibrated restriction means as 262*f*.

As the armature means continues its movement to the left (viewed in FIG. 33) the seal lip 280*f* completes its traverse of sleeve portion 420 and starts its traverse of path, recess or slot 410-3 resulting, at such transition, in the speed of movement, of the armature means, being increased. As should now be apparent, the armature means, at such increased speed, continues traversing slot 410-3 and then again becomes fluidly urged against the inner surface of sleeve 242*f* thereby again slowing the speed of armature travel which, in the embodiment of FIG. 33, continues until the armature means reaches its position at 104*f*-B.

In view of the foregoing it should be apparent that the openings 410, 410-1, 410-2 and 410-3 are functionally passage means for permitting or enabling augmenting fluid flow to what would be considered the axially low pressure end of the armature means 104*f*.

The passage or conduit means 410, 410-1, 410-2 and 410-3 have been illustrated as openings formed through the walls of the respective sleeves of FIGS. 26 (and 29, 31), 32 and 33. This may be the easiest manner of forming such passage means in situations wherein the thickness of the body, in which such passage means are being formed, is relatively thin. However, it should now be apparent that especially where the thickness of the body, in which such augmenting passage means are formed, is not relatively thin, such passage means may take the form of channels, reliefs or grooves formed as into and through the inner surface of the body, in which the armature is movable, without having to have such passage means break through the outer surface of such body.

Such action of increasing the armature speed, as at a selected point in its travel, is also shown in FIG. 23.

Although only selected preferred embodiments and several alternate embodiments and modifications of the invention have been disclosed and described, it is apparent that other embodiments and modifications are possible within the scope of the appended claims.

What is claimed is:

1. An electrically energized actuator assembly comprising electrical field coil means, armature means at least partly situated generally within said field coil means, resilient means, a fluid, and fluid-flow restriction means, wherein said electrical field coil means is effective upon being electrically energized to move said armature means in a first direction, wherein said armature means in moving in said first direction moves against resilient resistance of said resilient means, wherein upon said electrical field coil means becoming electrically de-energized said resilient means is effective to move said armature means in a second direction opposite to said first direction, wherein said armature means in moving in said second direction causes said fluid to flow through said fluid-flow restriction means, wherein said fluid-flow restriction means is effective to govern the speed at which said armature means moves in said second direction in accordance with the rate of flow of said fluid through said fluid-flow restriction means, and further comprising reservoir means for the containment and flow out of and into of said fluid, wherein said fluid comprises a liquid, first and second conduit means respectively comprising calibrated restriction means and check-valve means and communicating with said reservoir means, wherein said calibrated restriction means comprises said fluid-flow restriction means, wherein when said armature means moves in said first direction said armature means causes said liquid to flow through said check-valve means and into said reservoir means, and wherein when said armature means moves in said second direction said armature means causes said liquid to flow from said reservoir means and through said calibrated restriction means.

2. An electrically energized actuator assembly comprising electrical field coil means, armature means at least partly situated generally within said field coil means, resilient means, a fluid, and fluid-flow restriction means, wherein said electrical field coil means is effective upon being electrically energized to move said armature means in a first direction, wherein said armature means in moving in said first direction moves against resilient resistance of said resilient means, wherein upon said electrical field coil means becoming electrically de-energized said resilient means is effective to move said armature means in a second direction opposite to said first direction, wherein said armature means in moving in said second direction causes said fluid to flow through said fluid-flow restriction means, wherein said fluid-flow restriction means is effective to govern the speed at which said armature means moves in said second direction in accordance with the rate of flow of said fluid through said fluid-flow restriction means, and further comprising axially extending bobbin means, wherein said bobbin means is comprised of dielectric material and comprises a generally intermediate axially extending cylindrically tubular body portion, a generally radially outwardly extending flange carried by said cylindrically tubular body portion, a transverse body portion carried by said cylindrically tubular body portion as to be axially spaced from said flange, wherein said field coil means is formed on and about said cylindrically tubular body portion and axially contained between said flange and said transverse body portion, a generally cylindrical passageway formed axially through said cylindrically tubular body portion, a generally cylindrically tubular sleeve, said sleeve comprising a generally cylindrical axially extending outer surface and a generally cylindrical axially extending passage, wherein said tubular sleeve is at least for the most part situated in said cylindrical passageway, wherein said armature means comprises a generally cylindrically elongated armature body, and wherein said armature body is slidably received by said axially extending passage of said tubular sleeve.

3. An electrically energized actuator according to claim 2 wherein said cylindrically tubular sleeve is comprised of material other than the material of which said bobbin means is comprised.

4. An electrically energized actuator according to claim 2 wherein said cylindrically tubular sleeve is comprised of a metal unresponsive to magnetic flux.

5. An electrically energized actuator according to claim 2 wherein said cylindrically tubular sleeve is comprised of brass.

6. An electrically energized actuator according to claim 2 wherein said cylindrically tubular sleeve is tightly held within said cylindrical passageway of said bobbin means so that said tubular sleeve does not undergo motion relative to said bobbin means as said armature body is caused to move in said first and second directions.

7. An electrically energized actuator according to claim 2 wherein said dielectric material comprises a plastics material capable of exhibiting at least a minor degree of resilient deformation, wherein said generally cylindrical passageway is comprised of an axially extending generally cylindrical inner wall surface, and further comprising a plurality of spaced protuberances generally carried by and projecting from said cylindrical inner wall surface inwardly thereof, wherein said cylindrically tubular sleeve is received by said cylindrical passageway of said bobbin means in a manner whereby at least some of said protuberances are engaged by said tubular sleeve so that such protuberances effectively hold said tubular sleeve against motion relative to said bobbin means when said armature body is caused to move in said first and second directions.

8. An electrically energized actuator according to claim 7 wherein said plurality of spaced protuberances are formed integrally with and to said cylindrical inner wall surface, and wherein when said cylindrically tubular sleeve is received by said cylindrical passageway of said bobbin means said tubular sleeve causes at least some of said protuberances to undergo resilient deflection.

9. An electrically energized actuator according to claim 2 wherein said dielectric material comprises a plastics material capable of exhibiting at least a minor degree of resilient deformation, wherein said generally cylindrical passageway is comprised of an axially extending generally cylindrical inner wall surface, and further comprising a plurality of generally axially extending rib-like portions generally carried by and projecting from said cylindrical inner wall surface radially inwardly thereof, wherein said plurality of rib-like portions are angularly spaced about the axis of said cylindrical passageway, wherein said cylindrically tubular sleeve is received by said cylindrical passageway of said bobbin means in a manner whereby at least some of said rib-like portions are engaged by said tubular sleeve so that such rib-like portions effectively hold said tubular sleeve against motion relative to said bobbin means when said armature means is caused to move in said first and second directions.

10. An electrically energized actuator according to claim 9 wherein said plurality of angularly spaced rib-like portions are formed integrally with and to said cylindrical inner wall surface, and wherein when said cylindrically tubular sleeve is received by said cylindrical passageway of said bobbin means said tubular sleeve causes at least some of said rib-like portions to undergo resilient deflection.

11. An electrically energized actuator according to claim 9 wherein when viewed as in cross-section which is transverse to the axis of said cylindrical passageway of said bobbin means at least some of said rib-like portions have a generally triangular configuration with the apex thereof being furthermost displaced from said cylindrical inner wall surface.

12. An electrically energized actuator according to claim 2 and further comprising resiliently deflectable abutment means carried generally about said cylindrical passageway and as to be generally against said radiating flange, said resiliently deflectable abutment means being disposed as to be at an axial side of said radiating flange which axial side is opposite to that side of said flange which axially contains said field coil means, and wherein when said bobbin means is assembled to a cooperating flux conducting body said resiliently deflectable abutment means is effective to operatively engage said flux conducting body so as to assure an effectively tight fit with said flux conducting body and axially of said bobbin means.

13. An electrically energized actuator according to claim 2 and further comprising generally internally situated abutment means within said cylindrical passageway, said internally situated abutment means being situated axially closer to said radiating flange than to said transverse body portion, and wherein when said tubular sleeve is inserted into said cylindrical passageway of said bobbin means said internally situated abutment means is effective to operatively abut against said tubular sleeve and preclude further motion of said tubular sleeve in the direction of said internally situated abutment means.

14. An electrically energized actuator according to claim 13 wherein said bobbin means is comprised of dielectric plastics material capable of exhibiting at least a minor degree of resilient deflection, wherein said internally situated abutment means is integrally formed as to comprise an integral portion of said bobbin means.

15. An electrically energized actuator according to claim 2 wherein said armature body is comprised of differing materials, wherein a major portion of said armature body is comprised of magnetically responsive material, wherein a minor portion of said armature body is comprised of dielectric material, and wherein said major portion and said minor portion of said armature body are operatively connected to each other for movement in unison with each other.

16. An electrically energized actuator according to claim 2 wherein said fluid-flow restriction means comprises a restrictor body which carries said fluid-flow restriction means, wherein said restrictor body is received in said cylindrical passageway of said bobbin means, and wherein said fluid-flow restriction means comprises calibrated passage means communicating with an area generally axially between said restrictor body and said armature body.

17. An electrically energized actuator according to claim 16 wherein said calibrated passage means comprises a member of selected porosity for permitting flow therethrough in accordance with pre-established flow parameters.

18. An electrically energized actuator according to claim 2 and further comprising resiliently deflectable abutment means carried at an axial end of said bobbin means, wherein when said bobbin means is assembled to a cooperating flux conducting body said resiliently deflectable abutment means is effective to resiliently operatively engage said flux conducting body so as to assure an effectively tight fit with said flux conducting body and axially of said bobbin means.

19. An electrically energized actuator assembly comprising electrical field coil means, armature means at least partly situated generally within said field coil means, resilient means, a fluid, and fluid-flow restriction means, wherein said electrical field coil means is effective upon being electrically energized to move said armature means in a first direction, wherein said armature means in moving in said first direction moves against resilient resistance of said resilient means, wherein upon said electrical field coil means becoming electrically de-energized said resilient means is effective to move said armature means in a second direction opposite to said first direction, wherein said armature means in moving in said second direction causes said fluid to flow through said fluid-flow restriction means, wherein said fluid-flow restriction means is effective to govern the speed at which said armature means moves in said second direction in accordance with the rate of flow of said fluid through said fluid-flow restriction means, and further comprising axially extending bobbin means, wherein said bobbin means comprises a generally intermediate axially extending cylindrically tubular body portion, a generally radially outwardly extending flange carried by said cylindrically tubular body portion, a transverse body portion carried by said cylindrically tubular body portion as to be axially spaced from said flange, wherein said field coil means is formed on and about said cylindrically tubular body portion and axially contained between said flange and said transverse body portion, a flux conducting body, a generally cylindrical passageway formed through said cylindrically tubular body portion, a stop member received in said cylindrical passageway and operatively connected to a wall of said flux conducting body, wherein said armature means comprises a generally cylindrically elongated armature body also received by said cylindrical passageway, wherein said stop member is effective to stop movement of said elongated armature body in a direction toward said stop member, wherein said fluid-flow restriction means extends through said stop member and is in communication with a fluid reservoir, fluid sealing means carried by said elongated armature body, wherein when said armature body is positioned away from said stop member a space exists between said armature body and said stop member, wherein when said armature body moves toward said stop member fluid as is contained within said space is forced through said fluid-flow restriction means and to said reservoir with comparatively little restriction to flow of said fluid, and wherein when said armature body is moving away from said stop member fluid flowing from said reservoir through said fluid-flow restriction means and to said space between said stop member and said armature body experiences comparatively high restriction to flow of said fluid.

20. An electrically energized actuator assembly comprising electrical field coil means, armature means at least partly situated generally within said field coil means, resilient means, a fluid, and fluid-flow restriction means, wherein said electrical field coil means is effective upon being electrically energized to move said armature means in a first direction, wherein said armature means in moving in said first direction moves against resilient resistance of said resilient means, wherein upon said electrical field coil means becoming electrically de-energized said resilient means is effective to move said armature means in a second direction opposite to said first direction, wherein said armature means in moving in said second direction causes said fluid to flow through said fluid-flow restriction means, wherein said fluid-flow restriction means is effective to govern the speed at which said armature means moves in said second direction in accordance with the rate of flow of said fluid through said fluid-flow restriction means, and further comprising axially extending bobbin means, wherein said bobbin means comprises a generally intermediate axially extending cylindrically tubular body portion, a generally radially outwardly extending flange carried by said cylindrically tubular body portion, a transverse body portion carried by said cylindrically tubular body portion as to be axially spaced from said flange, wherein said field coil means is formed on and about said cylindrically tubular body portion and axially contained between said flange and said transverse body portion, a flux conducting body, a generally cylindrical passageway formed through said cylindrically tubular body portion, a stop member received in said cylindrical passageway and operatively connected to a wall of said flux conducting body, wherein said armature means comprises a generally cylindrically elongated armature body also received by said cylindrical passageway, wherein said stop member is effective to stop movement of said elongated armature body in a direction toward said stop member, wherein said fluid-flow restriction means is carried by said stop member, and fluid sealing means carried by said elongated armature body, wherein said fluid sealing means permits the flow of said fluid therepast when said elongated armature body is moving axially in one direction in said cylindrical passage, wherein said fluid sealing means seals against the flow of said fluid therepast when said elongated armature body is moving axially in said cylindrical passage in a second direction opposite to said one direction, wherein said cylindrical passageway comprises a first cylindrical passageway portion of a first diameter and a second cylindrical passageway portion of a second diameter larger than said first diameter, wherein said first cylindrical passageway portion and said second cylindrical passageway portion are in series communication with each other, wherein said cylindrically elongated armature body comprises a first cylindrical armature body portion of a first diameter and a second cylindrical armature body portion of a second diameter larger than said first diameter of said first cylindrical armature body portion, wherein said first cylindrical armature body portion is slidably received in said first cylindrical passageway portion and wherein said second cylindrical armature body portion is slidably received in said second cylindrical passageway portion, wherein said fluid sealing means is carried by said first cylindrical armature body portion, and wherein when said armature body is moved axially to a distance whereby said fluid sealing means is within said second cylindrical passageway portion said fluid sealing means ceases to provide a sealing function.

21. An electrically energized actuator assembly comprising electrical field coil means, armature means at least partly situated generally within said field coil means, resilient means, a fluid, and fluid-flow restriction means, wherein said electrical field coil means is effective upon being electrically energized to move said armature means in a first direction, wherein said armature means in moving in said first direction moves against resilient resistance of said resilient means, wherein upon said electrical field coil means becoming electrically de-energized said resilient means is effective to move said armature means in a second direction opposite to said first direction, wherein said armature means in moving in said second direction causes said fluid to flow through said fluid-flow restriction means, wherein said fluid-flow restriction means is effective to govern the speed at which said armature means moves in said second direction in accordance with the rate of flow of said fluid through said fluid-flow restriction means, and further comprising axially extending bobbin means, wherein said bobbin means comprises a generally intermediate axially extending cylindrically tubular body portion, a generally radially outwardly extending flange carried by said cylindrically tubular body portion, a transverse body portion carried by said cylindrically tubular body portion as to be axially spaced from said flange, wherein said field coil means is formed on and about said cylindrically tubular body portion and axially contained between said flange and said transverse body portion, a flux conducting body, a generally cylindrical passageway formed through said cylindrically tubular body portion, a stop member received in said cylindrical passageway and operatively connected to a wall of said flux conducting body, wherein said armature means comprises a generally cylindrically elongated armature body also received by said cylindrical passageway, wherein said stop member is effective to stop movement of said elongated armature body in a direction toward said stop member, fluid sealing means carried by said elongated armature body, wherein said fluid sealing means permits the flow of said fluid therepast when said elongated armature body is moving axially in one direction in said cylindrical passage, and wherein said fluid sealing means seals against the flow of said fluid therepast when said elongated armature body is moving axially in said cylindrical passage in a second direction opposite to said one direction, and wherein said fluid-flow restriction means comprises a flow passage formed by said stop member and a valving member carried by said armature body, wherein as said armature body moves toward said stop member said valving member is received by said flow passage as to thereby alter the effective flow area of said flow passage.

22. An electrically energized actuator assembly comprising electrical field coil means, armature means at least partly situated generally within said field coil means, resilient means, a fluid, and fluid-flow restriction means, wherein said electrical field coil means is effective upon being electrically energized to move said armature means in a first direction, wherein said armature means in moving in said first direction moves against resilient resistance of said resilient means, wherein upon said electrical field coil means becoming electrically de-energized said resilient means is effective to move said armature means in a second direction opposite to said first direction, wherein said armature means in moving in said second direction causes said fluid to flow through said fluid-flow restriction means, wherein said fluid-flow restriction means is effective to govern the speed at which said armature means moves in said second direction in accordance with the rate of flow of said fluid through said fluid-flow restriction means, and further comprising axially extending bobbin means, wherein said bobbin means comprises a generally intermediate axially extending cylindrically tubular body portion, a generally radially outwardly extending flange carried by said cylindrically tubular body portion, a transverse body portion carried by said cylindrically tubular body portion as to be axially spaced from said flange, wherein said field coil means is formed on and about said cylindrically tubular body portion and axially contained between said flange and said transverse body portion, a flux conducting body, a generally cylindrical passageway formed through said cylindrically tubular body portion, a stop member received in said cylindrical passageway and operatively connected to a wall of said flux conducting body, wherein said armature means comprises a generally cylindrically elongated armature body also received by said cylindrical passageway, wherein said stop member is effective to stop movement of said elongated armature body in a direction toward said stop member, wherein said fluid-flow restriction means comprises a dash-pot, wherein said dash-pot comprises a chamber of variable volume for containing said fluid, wherein said chamber is defined at least in part by a movable wall, wherein said fluid-flow restriction means further comprises a calibrated flow-passage communicating with said chamber, and wherein when said armature body is caused to move toward said chamber said movable wall moves to reduce the volume of said chamber to thereby force any of said fluid in said chamber out through said calibrated flow-passage.

23. An electrically energized actuator assembly comprising electrical field coil means, an armature at least partly situated generally within said field coil means, resilient means, a fluid, and fluid-flow restriction means, wherein said electrical field coil means is effective upon being electrically energized to move said armature in a first direction, wherein said armature in moving in said first direction moves against resilient resistance of said resilient means, wherein upon said electrical field coil means becoming electrically de-energized said resilient means is effective to move said armature in a second direction opposite to said first direction, wherein said armature in moving in said second direction causes said fluid to flow through said fluid-flow restriction means, wherein said fluid-flow restriction means is effective to govern the speed at which said armature moves in said second direction in accordance with the rate of flow of said fluid through said fluid-flow restriction means, and further comprising an axially extending bobbin, wherein said bobbin comprises a generally axially extending cylindrically tubular body portion, wherein said field coil means is formed on and about said cylindrically tubular body portion, a generally cylindrical passageway formed axially through said cylindrically tubular body portion, a generally cylindrically tubular sleeve, said sleeve comprising a generally cylindrical axially extending outer surface and a generally cylindrical axially extending passage, wherein said tubular sleeve is at least for the most part situated in said cylindrical passageway, wherein said armature comprises a generally cylindrical armature body, and wherein said armature body is slidably received by said axially extending passage of said tubular sleeve.

24. An electrically energized actuator according to claim 23 and further comprising resiliently deflectable abutment means carried at an axial end of said bobbin, wherein when said bobbin is assembled to a cooperating flux conducting body said resiliently deflectable abutment means is effective to resiliently operatively engage said flux conducting body so as to assure an effectively tight fit with said flux conducting body and axially of said bobbin.

25. An electrically energized actuator assembly comprising electrical field coil means, armature means at least partly situated generally within said field coil means, resilient means, a fluid, fluid-flow restriction means, wherein said electrical field coil means is effective upon being electrically energized to move said armature means in a first direction, wherein said armature means in moving in said first direction moves against resilient resistance of said resilient means, wherein upon said electrical field coil means becoming electrically de-energized said resilient means is effective to move said armature means in a second direction opposite to said first direction, wherein said armature means in moving in said second direction causes said fluid to flow through said fluid-flow restriction means, and wherein said fluid-flow restriction means is effective to govern the speed at which said armature means moves in said second direction with such governed speed being in accordance with the rate of flow of said fluid through said fluid-flow restriction means, wherein the speed at which said armature means moves in said second direction is relatively slow compared to the speed at which said armature means moves in said first direction, and further comprising vent means, said vent means being effective to at times augment the total rate of said fluid-flow by having said fluid also flow through said vent means when said armature means moves in said second direction and after a preselected extent of movement of said armature means in said second direction serves to open said vent to the flow of said fluid through said open vent, and whereby when a flow of fluid through said vent augments the flow of said fluid through said fluid-flow restriction means the speed of movement of said armature means quickly increases to a speed substantially greater than said relatively slow speed.

26. An electrically energized actuator assembly according to claim 25 wherein said fluid comprises ambient air.

27. An electrically energized actuator assembly according to claim 25 wherein the speed at which said armature means moves in said second direction for a preselected distance is less than the speed at which said armature means moves in said first direction, and wherein said armature means when reaching said preselected distance moves at a speed greater than the speed at which the armature means moved in said second direction prior to arriving at said preselected distance.

28. An electrically energized actuator assembly comprising electrical field coil means, armature means at least partly situated generally within said field coil means, resilient means, a fluid, fluid-flow restriction means, wherein said electrical field coil means is effective upon being electrically energized to move said armature means in a first direction, wherein said armature means in moving in said first direction moves against resilient resistance of said resilient means, wherein upon said electrical field coil means becoming electrically de-energized said resilient means is effective to move said armature means in a second direction opposite to said first direction, wherein said armature means in moving in said second direction causes said fluid to flow through said fluid-flow restriction means, and wherein said fluid-flow restriction means is effective to govern the speed at which said armature means moves in said second direction with such governed speed being in accordance with the rate of flow of said fluid through said fluid-flow restriction means, wherein the speed at which said armature means moves in said second direction is relatively slow compared to the speed at which said armature means moves in said first direction, and further comprising vent means, said vent means being effective to at times augment the total rate of said fluid-flow by having said fluid also flow through said vent means when said armature means moves in said second direction and after a preselected extent of movement of said armature means in said second direction serves to open said vent to the flow of said fluid through said open vent, and whereby when a flow of fluid through said vent augments the flow of said fluid through said fluid-flow restriction means the speed of movement of said armature means quickly increases to a speed substantially greater than said relatively slow speed, wherein said fluid comprises a liquid.

29. An electrically energized actuator assembly comprising electrical field coil means, armature means at least partly situated generally within said field coil means, resilient means, a fluid, fluid-flow restriction means, wherein said electrical field coil means is effective upon being electrically energized to move said armature means in a first direction, wherein said armature means in moving in said first direction moves against resilient resistance of said resilient means, wherein upon said electrical field coil means becoming electrically de-energized said resilient means is effective to move said armature means in a second direction opposite to said first directions. Wherein said armature means in moving in said second direction causes said fluid to flow through said fluid-flow restriction means, and wherein said fluid-flow restriction means is effective to govern the speed at which said armature means moves in said second direction with such governed speed being in accordance with the rate of flow of said fluid through said fluid-flow restriction means, wherein the speed at which said armature means moves in said second direction is relatively slow compared to the speed at which said armature means moves in said first direction, and further comprising vent means, said vent means being effective to at times augment the total rate of said fluid-flow by having said fluid also flow through said vent means when said armature means moves in said second direction and after a preselected extent of movement of said armature means in said second direction serves to open said vent to the flow of said fluid through said open vent, and whereby when a flow of fluid through said vent augments the flow of said fluid through said fluid-flow restriction means the speed of movement of said armature means quickly increases to a speed substantially greater than said relatively slow speed, wherein said fluid comprises a liquid, and wherein said liquid comprises water.

30. An electrically energized actuator assembly comprising electrical field coil means, armature means at least partly situated generally within said field coil means, resilient means, a fluid, fluid-flow restriction means, wherein said electrical field coil means is effective upon being electrically energized to move said armature means in a first direction, wherein said armature means in moving in said first direction moves against resilient resistance of said resilient means, wherein upon said electrical field coil means becoming electrically de-energized said resilient means is effective to move said armature means in a second direction opposite to said first direction, wherein said armature means in moving in said second direction causes said fluid to flow through said fluid-flow restriction means, and wherein said fluid-flow restriction means is effective to govern the speed at which said armature means moves in said second direction with such governed speed being in accordance with the rate of flow of said fluid through said fluid-flow restriction means, wherein the speed at which said armature means moves in said second direction is relatively slow compared to the speed at which said armature means moves in said first direction, and further comprising vent means, said vent means being effective to at times augment the total rate of said fluid-flow by having said fluid also flow through said vent means when said armature means moves in said second direction and after a preselected extent of movement of said armature means in said second direction serves to open said vent to the flow of said fluid through said open vent, and whereby when a flow of fluid through said vent augments the flow of said fluid through said fluid-flow restriction means the speed of movement of said armature means quickly increases to a speed substantially greater than said relatively slow speed, wherein said fluid comprises a liquid, and wherein said liquid comprises oil.

31. An electrically energized actuator assembly comprising electrical field coil means, armature means at least partly situated generally within said field coil means, resilient means, a fluid, and fluid-flow restriction means, wherein said electrical field coil means is effective upon being electrically energized to move said armature means in a first direction, wherein said armature means in moving in said first direction moves against resilient resistance of said resilient means, wherein upon said electrical field coil means becoming electrically de-energized said resilient means is effective to move said armature means in a second direction opposite to said first direction, wherein said armature means in moving in said second direction causes said fluid to flow through said fluid-flow restriction means, wherein said fluid-flow restriction means is effective to govern the speed at which said armature means moves in said second direction in accordance with the rate of flow of said fluid through said fluid-flow restriction means, further comprising axially extending bobbin means, wherein said bobbin means comprises a generally intermediate axially extending cylindrically tubular body portion, wherein said field coil means is formed on and about said cylindrically tubular body portion, a flux conducting body, a generally cylindrical passage formed through said cylindrically tubular body portion, a stop member received in said cylindrical passage, wherein said armature means comprises a generally cylindrically elongated armature body also received by said cylindrical passage, wherein said stop member is effective to stop movement of said elongated armature body in a direction toward said stop member, wherein said fluid-flow restriction means is carried by said stop member, fluid sealing means carried by said elongated armature body, wherein said fluid sealing means comprises a resiliently flexible sealing member carried generally circumferentially by and about said generally cylindrically elongated armature body as to move in unison with said armature body and relative to said cylindrical passage, wherein said fluid sealing means permits the flow of said fluid between said cylindrical passage and said flexible sealing member when said elongated armature body is moving axially in one direction in said cylindrical passage, and wherein said fluid sealing means seals against the flow of said fluid between said cylindrical passage and said flexible sealing member when said elongated armature body is moving axially in said cylindrical passage in a second direction opposite to said one direction.

32. An electrically energized actuator assembly comprising electrical field coil means, armature means at least partly situated generally within said field coil means, resilient means, a fluid, and fluid-flow restriction means, wherein said electrical field coil means is effective upon being electrically energized to move said armature means in a first direction, wherein said armature means in moving in said first direction moves against resilient resistance of said resilient means, wherein upon said electrical field coil means becoming electrically de-energized said resilient means is effective to move said armature means in a second direction opposite to said first direction, wherein said armature means in moving in said second direction causes said fluid to flow through said fluid-flow restriction means, wherein said fluid-flow restriction means is effective to govern the speed at which said armature means moves in said second direction in accordance with the rate of flow of said fluid through said fluid-flow restriction means, and further comprising axially extending bobbin means, wherein said bobbin means is comprised of dielectric material and comprises a generally intermediate axially extending cylindrically tubular body portion, a first generally radially outwardly extending flange carried by said cylindrically tubular body portion, a second generally radially outwardly extending flange carried by said cylindrically tubular body portion as to be axially spaced from said first flange, wherein said field coil means is formed on and about said cylindrically tubular body portion and axially contained between said first flange and said second flange, a generally cylindrical passageway formed axially through said cylindrically tubular body portion, a generally cylindrically tubular sleeve, said sleeve comprising a generally cylindrical axially extending outer surface and a generally cylindrical axially extending passage, wherein said tubular sleeve is at least for the most part situated in said cylindrical passageway, wherein said armature means comprises a generally cylindrically elongated armature body, wherein said armature body is slidably received by said axially extending passage of said tubular sleeve, and passage means carried by said tubular sleeve and at times traversed by said armature means, said passage means communicating with a source of said fluid and depending on the position of said armature means being effective to supply said fluid as to in essence combine with the fluid flow through said restriction means and thereby effectively diminish the degree of control previously delivered by said fluid flowing through said restriction means as to result in a substantial increase in speed of movement of said armature means in said second direction.

33. An electrically energized actuator according to claim 32 wherein said cylindrically tubular sleeve is comprised of material other than the material of which said bobbin means is comprised, wherein said passage means comprises vent like openings formed in said tubular sleeve so that the fluid to flow therethrough is made able to effectively bypass a portion of said armature means and to effectively augment the rate of flow of said fluid through said fluid-flow restriction means thereby substantially increasing the speed at which said armature means moves in said second direction.

34. An electrically energized actuator according to claim 32 wherein said cylindrically tubular sleeve is comprised of a metal unresponsive to magnetic flux.

35. An electrically energized actuator according to claim 32 wherein said cylindrically tubular sleeve is comprised of brass.

36. An electrically energized actuator according to claim 32 wherein said cylindrically tubular sleeve is tightly held within said cylindrical passageway of said bobbin means so that said tubular sleeve does not undergo motion relative to said bobbin means as said armature body is caused to move in said first and second directions, and further comprising keying means collectively carried by said bobbin means and said tubular sleeve, said keying means assuring that said tubular sleeve can be correctly assembled to said bobbin means when said tubular sleeve has attained a preselected physical relationship with respect to said bobbin means.

37. An electrically energized actuator according to claim 32 wherein said fluid-flow restriction means comprises a restrictor body which carries said fluid-flow restriction means, wherein said restrictor body is received in said cylindrical passageway of said bobbin means, and wherein said fluid-flow restriction means comprises calibrated passage means communicating with an area generally axially between said restrictor body and said armature body.

38. An electrically energized actuator according to claim 37 wherein said calibrated passage means comprises a member of selected porosity for permitting flow therethrough in accordance with pre-established flow parameters.

39. An electrically energized actuator assembly comprising electrical field coil means, armature means at least partly situated generally within said field coil means, resilient means, a source of a fluid, and fluid-flow restriction means, wherein said electrical field coil means is effective upon being electrically energized to move said armature means in a first direction toward a first extreme position of said armature means, wherein said armature means in moving in said first direction moves against resilient resistance of said resilient means, wherein upon said electrical field coil means becoming electrically de-energized said resilient means is effective to move said armature means in a second direction opposite to said first direction toward a second extreme position of said armature means, wherein said armature means in moving in said second direction causes said fluid to flow through said fluid-flow restriction means, wherein said fluid-flow restriction means is effective to govern the speed at which said armature means moves in said second direction in accordance with the rate of flow of said fluid through said fluid-flow restriction means, axially extending bobbin means, wherein said bobbin means comprises a generally intermediate axially extending cylindrically tubular body portion, a generally radially outwardly extending flange carried by said cylindrically tubular body portion, a transverse body portion carried by said cylindrically tubular body portion as to be axially spaced from said flange, wherein said field coil means is formed on and about said cylindrically tubular body portion and axially contained between said flange and said transverse body portion, a generally cylindrical passageway formed through said cylindrically tubular body portion, wherein said armature means comprises a generally cylindrically elongated armature body comprising a first axial end and received by said cylindrical passageway, fluid sealing means carried generally peripherally about said elongated armature body and in sliding contact with said cylindrical passageway, wherein when said armature body is moving in said first direction said sealing means permits the relatively unrestricted flow of said fluid between itself and said cylindrical passageway, and wherein when said armature body is moving in said second direction fluid flowing from said source of fluid through said fluid-flow restriction means normally is applied against said first axial end of said armature body thereby causing said armature body to have its speed of movement in said second direction retarded.

40. An electrically energized actuator assembly according to claim 39 and further comprising vent means communicating with said source of said fluid, wherein said armature body while moving in said second direction is effective at a preselected location while moving in said second direction to enable said vent means to supply a rate of flow of said fluid to be applied against said first axial end of said armature body, the rate of flow of said fluid effectively augmenting the otherwise normal rate of flow of said fluid through said fluid-flow restriction means and thereby significantly increasing the speed of movement of said armature body to a magnitude greater than the speed of movement of said armature body would have been in said second direction if controlled only by the rate of flow of said fluid flowing from said fluid-flow restriction means and applied to said first axial end of said armature body.

41. An electrically energized actuator assembly according to claim 40 wherein said vent means is so situated that said armature body experiences said increasing speed of movement as said armature body approaches and continues in its movement toward and to said second extreme position.

42. An electrically energized actuator assembly comprising electrical field coil means, armature means at least partly situated generally within said field coil means, resilient means, a source of a fluid, and fluid-flow restriction means, wherein said electrical field coil means is effective upon being electrically energized to move said armature means in a first direction toward a first extreme position of said armature means, wherein said armature means in moving in said first direction moves against resilient resistance of said resilient means, wherein upon said electrical field coil means becoming electrically de-energized said resilient means is effective to move said armature means in a second direction opposite to said first direction toward a second extreme position of said armature means, wherein said armature means in moving in said second direction causes said fluid to flow through said fluid-flow restriction means, wherein said fluid-flow restriction means is effective to govern the speed at which said armature means moves in said second direction in accordance with the rate of flow of said fluid through said fluid-flow restriction means, axially extending bobbin means, wherein said bobbin means comprises a generally intermediate axially extending cylindrically tubular body portion, a generally radially outwardly extending flange carried by said cylindrically tubular body portion, a transverse body portion carried by said cylindrically tubular body portion as to be axially spaced from said flange, wherein said field coil means is formed on and about said cylindrically tubular body portion and axially contained between said flange and said transverse body portions a generally cylindrical passageway formed through said cylindrically tubular body portion, wherein said armature means comprises a generally cylindrically elongated armature body comprising a first axial end and received by said cylindrical passageway, fluid sealing means carried by said elongated armature body, wherein when said armature body is moving in said first direction said sealing means permits the relatively unrestricted flow of said fluid therepast, and wherein when said armature body is moving in said second direction fluid flowing from said source of fluid through said fluid-flow restriction means normally is applied against said first axial end of said armature body thereby causing said armature body to have its speed of movement in said second direction retarded, and further comprising vent means communicating with said source of said fluid, wherein said armature body while moving in said second direction is effective at a preselected location while moving in said second direction to enable said vent means to supply a rate of flow of said fluid to be applied against said first axial end of said armature body, the rate of flow of said fluid effectively augmenting the otherwise normal rate of flow of said fluid through said fluid-flow restriction means and thereby significantly increasing the speed of movement of said armature body to a magnitude greater than the speed of movement of said armature body would have been in said second direction if controlled only by the rate of flow of said fluid flowing from said fluid-flow restriction means and applied to said first axial end of said armature body, and further comprising a cylindrical tubular sleeve received by said cylindrical passageway, wherein said armature body is received by said cylindrical tubular sleeve, and wherein said vent means is formed in said cylindrical tubular sleeve.

43. An electrically energized actuator assembly comprising electrical field coil means, armature means at least partly situated generally within said field coil means, resilient means, a source of a fluid, and fluid-flow restriction means, wherein said electrical field coil means is effective upon being electrically energized to move said armature means in a first direction toward a first extreme position of said armature means, wherein said armature means in moving in said first direction moves against resilient resistance of said resilient means, wherein upon said electrical field coil means becoming electrically de-energized said resilient means is effective to move said armature means in a second direction opposite to said first direction toward a second extreme position of said armature means, wherein said armature means in moving in said second direction causes said fluid to flow through said fluid-flow restriction means, wherein said fluid-flow restriction means is effective to govern the speed at which said armature means moves in said second direction in accordance with the rate of flow of said fluid through said fluid-flow restriction means, axially extending bobbin means, wherein said bobbin means comprises a generally intermediate axially extending cylindrically tubular body portion, a generally radially outwardly extending flange carried by said cylindrically tubular body portion, a transverse body portion carried by said cylindrically tubular body portion as to be axially spaced from said flange, wherein said field coil means is formed on and about said cylindrically tubular body portion and axially contained between said flange and said transverse body portion, a generally cylindrical passageway formed through said cylindrically tubular body portion, wherein said armature means comprises a generally cylindrically elongated armature body comprising a first axial end and received by said cylindrical passageway, fluid sealing means carried by said elongated armature body, wherein when said armature body is moving in said first direction said sealing means permits the relatively unrestricted flow of said fluid therepast, and wherein when said armature body is moving in said second direction fluid flowing from said source of fluid through said fluid-flow restriction means normally is applied against said first axial end of said armature body thereby causing said armature body to have its speed of movement in said second direction retarded, and further comprising vent means communicating with said source of said fluid, wherein said armature body while moving in said second direction is effective at a preselected location while moving in said second direction to enable said vent means to supply a rate of flow of said fluid to be applied against said first axial end of said armature body, the rate of flow of said fluid effectively augmenting the otherwise normal rate of flow of said fluid through said fluid-flow restriction means and thereby significantly increasing the speed of movement of said armature body to a magnitude greater than the speed of movement of said armature body would have been in said second direction if controlled only by the rate of flow of said fluid flowing from said fluid-flow restriction means and applied to said first axial end of said armature body, wherein said vent means is so situated that said armature body experiences said increasing speed of movement as said armature body approaches and continues in its movement toward and to said second extreme position, and further comprising a cylindrical tubular sleeve received by said cylindrical passageway, wherein said armature body is received by said cylindrical tubular sleeve, and wherein said vent means is formed in said cylindrical tubular sleeve.

44. An electrically energized actuator assembly comprising electrical field coil means, armature means at least partly situated generally within said field coil means, resilient means, a source of a fluid, and fluid-flow restriction means, wherein said electrical field coil means is effective upon being electrically energized to move said armature means in a first direction toward a first extreme position of said armature means, wherein said armature means in moving in said first direction moves against resilient resistance of said resilient means, wherein upon said electrical field coil means becoming electrically de-energized said resilient means is effective to move said armature means in a second direction opposite to said first direction toward a second extreme position of said armature means, wherein said armature means in moving in said second direction causes said fluid to flow through said fluid-flow restriction means, wherein said fluid-flow restriction means is effective to govern the speed at which said armature means moves in said second direction in accordance with the rate of flow of said fluid through said fluid-flow restriction means, axially extending bobbin means, wherein said bobbin means comprises a generally intermediate axially extending cylindrically tubular body portion, a generally radially outwardly extending flange carried by said cylindrically tubular body portion, a transverse body portion carried by said cylindrically tubular body portion as to be axially spaced from said flange, wherein said field coil means is formed on and about said cylindrically tubular body portion and axially contained between said flange and said transverse body portions a generally cylindrical passageway formed through said cylindrically tubular body portion, wherein said armature means comprises a generally cylindrically elongated armature body comprising a first axial end and received by said cylindrical passageway, fluid sealing means carried by said elongated armature body, wherein when said armature body is moving in said first direction said sealing means permits the relatively unrestricted flow of said fluid therepast, and wherein when said armature body is moving in said second direction fluid flowing from said source of fluid through said fluid-flow restriction means normally is applied against said first axial end of said armature body thereby causing said armature body to have its speed of movement in said second direction retarded, and further comprising vent means communicating with said source of said fluid, wherein said armature body while moving in said second direction is effective at a preselected location while moving in said second direction to enable said vent means to supply a rate of flow of said fluid to be applied against said first axial end of said armature body, the rate of flow of said fluid effectively augmenting the otherwise normal rate of flow of said fluid through said fluid-flow restriction means and thereby significantly increasing the speed of movement of said armature body to a magnitude greater than the speed of movement of said armature body would have been in said second direction if controlled only by the rate of flow of said fluid flowing from said fluid-flow restriction means and applied to said first axial end of said armature body, wherein said vent means comprises at least first and second vents each of which communicates with said source of said fluid, wherein said first and second vents are effectively axially spaced from each other as to be respectively situated at first and second locations, and wherein said armature body in moving from said first extreme position toward said second extreme position sequentially enables said second vent at said second location and subsequently said first vent at said first location to supply said fluid from said source of fluid and cause its application to said first axial end of said armature body thereby increasing the speed of movement of said armature body at generally each of said first and second locations while axially between such locations becoming totally controlled in its speed of movement by said flow of fluid from said fluid-flow restriction means and thereby significantly reducing the speed of movement of said armature body in its movement toward said second extreme position.

45. An electrically energized actuator assembly according to claim 44 and further comprising a cylindrical tubular sleeve received by said cylindrical passageway, wherein said armature body is received by said cylindrical tubular sleeve, and wherein said first and second vents are formed in said cylindrical tubular sleeve.

46. An electrically energized actuator assembly, comprising an electrically energizable field coil, an armature movable in response to energization of said field coil, an electrical circuit, wherein when said electrical circuit is closed said field coil is energized as to cause said armature to move in a first direction toward a first extreme position, resilient means for resiliently resisting the movement of said armature in said first direction, wherein when said electrical circuit is opened said field coil is de-energized permitting said resilient means to move said armature in a second direction toward a second extreme position, and delay means, said delay means being effective to retard the movement of said armature in said second direction whereby in comparison the speed of movement of said armature in said first direction against the resilient resistance of said resilient means is purposely faster than the speed of movement of said armature in said second direction, and additional means which become operative upon said armature attaining a preselected location in its movement toward said second extreme position to override the otherwise normal operation of said delay means and thereby significantly increase the speed of movement of said armature in said second direction.

47. An electrically energized actuator assembly comprising electrical field coil means, armature means at least partly situated generally within said field coil means, resilient means, a fluid, and fluid-flow restriction means, wherein said electrical field coil means is effective upon being electrically energized to move said armature means in a first direction, wherein said armature means in moving in said first direction moves against resilient resistance of said resilient means, wherein upon said electrical field coil means becoming electrically de-energized said resilient means is effective to move said armature means in a second direction opposite to said first direction, wherein said armature means in moving in said second direction causes said fluid to flow through said fluid-flow restriction means, wherein said fluid-flow restriction means is effective to govern the speed at which said armature means moves in said second direction in accordance with the rate of flow of said fluid through said fluid-flow restriction means, and further comprising axially extending bobbin means, wherein said bobbin means comprises a generally intermediate axially extending cylindrically tubular body portion, a first generally radially outwardly extending flange portion operatively carried by said cylindrically tubular body portion, a second generally radially outwardly extending flange portion operatively carried by said cylindrically tubular body portion as to be axially spaced from said first flange portion, wherein said field coil means is formed on and about said cylindrically tubular body portion and axially contained between said first and second flange portions, a flux conducting frame body, a generally cylindrical passage formed through said cylindrically tubular body portion, a stop member, a tubular sleeve comprising a generally cylindrical axially extending outer surface and a generally cylindrical axially extending passage, wherein said tubular sleeve is at least for the most part situated in said cylindrical passageway, wherein said armature means comprises a generally cylindrically elongated armature body, wherein said armature body is slidably received by said axially extending passage of said tubular sleeve, wherein said stop member is effective to stop movement of said elongated armature body in a direction toward said stop member, wherein said fluid-flow restriction means is carried by said stop member, fluid sealing means carried by said elongated armature body, wherein said fluid sealing means permits the flow of said fluid therepast when said elongated armature body is moving axially in said first direction in said cylindrical passage, and wherein said fluid sealing means seals against the flow of said fluid therepast when said elongated armature body is moving axially in said cylindrical passage in said second direction opposite to said first direction.

48. An electrically energized actuator assembly comprising electrical field coil means, armature means at least partly situated generally within said field coil means, resilient means, a source of fluid, and fluid-flow restriction means, wherein said electrical field coil means is effective upon being electrically energized to move said armature means in a first direction toward a first extreme position of said armature means, wherein said armature means in moving in said first direction moves against resilient resistance of said resilient means, wherein upon said electrical field coil means becoming electrically de-energized said resilient means is effective to move said armature means in a second direction opposite to said first direction toward a second extreme position of said armature means, wherein said armature means in moving in said second direction causes said fluid to flow through said fluid-flow restriction means, wherein said fluid-flow restriction means is effective to govern the speed at which said armature means moves in said second direction in accordance with the rate of flow of said fluid through said fluid-flow restriction means, axially extending bobbin means, wherein said bobbin means comprises a generally intermediate axially extending tubular body portion, a generally radially outwardly extending first flange carried by said tubular body portion, a generally radially outwardly extending second flange carried by said tubular body portion as to be axially spaced from said first flange, wherein said field coil means is formed on and about said tubular body portion and axially contained between said first and second flanges, a generally cylindrical passageway formed through said tubular body portion, wherein said armature means comprises a generally cylindrically elongated armature body comprising a first axial end and received by said cylindrical passageway, fluid sealing means carried by said elongated armature body, wherein when said armature body is moving in said first direction said sealing means permits the relatively unrestricted flow of said fluid therepast, and wherein when said armature body is moving in said second direction fluid flowing from said source of fluid through said fluid-flow restriction means normally is applied against said first axial end of said armature body thereby causing said armature body to have its speed of movement in said second direction retarded, and further comprising vent means communicating with said source of said fluid, wherein said armature body while moving in said second direction is effective at a preselected location while moving in said second direction to enable said vent means to supply a rate of flow of said fluid to be applied against said first axial end of said armature body, the rate of flow of said fluid effectively augmenting the otherwise normal rate of flow of said fluid through said fluid-flow restriction means and thereby significantly increasing the speed of movement of said armature body to a magnitude greater than the speed of movement of said armature body would have been in said second direction if controlled only by the rate of flow of said fluid flowing from said fluid-flow restriction means and applied to said first axial end of said armature body, wherein said vent means comprises at least first and second vents each of which communicates with said source of said fluid, wherein said first and second vents are effectively axially spaced from each other as to be respectively situated at first and second locations, and wherein said armature body in moving from said first extreme position toward said second extreme position sequentially enables said second vent at said second location and subsequently said first vent at said first location to supply said fluid from said source of fluid and cause its application to said first axial end of said armature body thereby increasing the speed of movement of said armature body at generally each of said first and second locations.

49. An electrically energized actuator assembly comprising electrical field coil means, armature means at least partly situated generally within said field coil means, resilient means, a source of fluid, and fluid-flow restriction means, wherein said electrical field coil means is effective upon being electrically energized to move said armature means in a first direction toward a first extreme position of said armature means, wherein said armature means in moving in said first direction moves against resilient resistance of said resilient means, wherein upon said electrical field coil means becoming electrically de-energized said resilient means is effective to move said armature means in a second direction opposite to said first direction toward a second extreme position of said armature means, wherein said armature means in moving in said second direction causes said fluid to flow through said fluid-flow restriction means, wherein said fluid-flow restriction means is effective to govern the speed at which said armature means moves in said second direction in accordance with the rate of flow of said fluid through said fluid-flow restriction means, axially extending bobbin means, wherein said bobbin means comprises a generally intermediate axially extending tubular body portion, a generally radially outwardly extending first flange carried by said tubular body portion, a generally radially outwardly extending second flange carried by said tubular body portion as to be axially spaced from said first flange, wherein said field coil means is formed on and about said tubular body portion and axially contained between said first and second flanges, a generally cylindrical passageway formed through said tubular body portion, wherein said armature means comprises a generally cylindrically elongated armature body comprising a first axial end and received by said cylindrical passageway, fluid sealing means carried by said elongated armature body, wherein when said armature body is moving in said first direction said sealing means permits the relatively unrestricted flow of said fluid therepast, and wherein when said armature body is moving in said second direction fluid flowing from said source of fluid through said fluid-flow restriction means normally is applied against said first axial end of said armature body thereby causing said armature body to have its speed of movement in said second direction retarded, and further comprising vent means communicating with said source of said fluid, wherein said armature body while moving in said second direction is effective at a preselected location while moving in said second direction to enable said vent means to supply a rate of flow of said fluid to be applied against said first axial end of said armature body, the rate of flow of said fluid effectively augmenting the otherwise normal rate of flow of said fluid through said fluid-flow restriction means and thereby significantly increasing the speed of movement of said armature body to a magnitude greater than the speed of movement of said armature body would have been in said second direction if controlled only by the rate of flow of said fluid flowing from said fluid-flow restriction means and applied to said first axial end of said armature body, wherein said vent means comprises at least first and second vents each of which communicates with said source of said fluid, wherein said first and second vents are effectively axially spaced from each other as to be respectively situated at first and second locations, and wherein said armature body in moving from said first extreme position toward said second extreme position sequentially enables said second vent at said second location and subsequently said first vent at said first location to supply said fluid from said source of fluid and cause its application to said first axial end of said armature body thereby increasing the speed of movement of said armature body at generally each of said first and second locations while axially between such locations becoming totally controlled in its speed of movement by said flow of fluid from said fluid-flow restriction means and thereby significantly reducing the speed of movement of said armature body in its movement toward said second extreme position.

* * * * *

UNITED STATES PATENT AND TRADEMARK OFFICE

CERTIFICATE OF CORRECTION

PATENT NO. : 5,578,978

DATED : November 26, 1996

INVENTOR(S) : Marty M. Zoerner

It is certified that error appears in the above-indentified patent and that said Letters Patent is hereby corrected as shown below:

On the title page: Item [75]

Change the Inventor's address to read
---- Harbor Springs, Michigan ----

Column 10, line 32, cancel "168a" and substitute therefor ---- 168b ----.

Column 26, line 8 (Claim 29, line 12 thereof), cancel "directions. Wherein" and substitute therefor ---- direction, wherein ----.

Column 30, line 23, (Claim 42, line 29), cancel "portions" and substitute therefor ---- portion, ----.

Column 32, line 15 (Claim 44, line 29), cancel "portions" and substitute therefor ---- portion, ----.

Signed and Sealed this

Fourth Day of March, 1997

*Attest:*

*Attesting Officer*

BRUCE LEHMAN

*Commissioner of Patents and Trademarks*